US005908365A

United States Patent [19]

LaJaunie et al.

[11] Patent Number: 5,908,365

[45] Date of Patent: Jun. 1, 1999

[54] DOWNHOLE TRIGGERING DEVICE

[75] Inventors: Craig C. LaJaunie, Centerville, La.; Steven C. Headley, Arlington, Tex.

[73] Assignee: Preeminent Energy Services, Inc., Broussard, La.

[21] Appl. No.: 08/794,974

[22] Filed: Feb. 5, 1997

[51] Int. Cl.[6] ..... E21B 43/1185

[52] U.S. Cl. ..... 475/4.56; 166/63; 166/66.5; 166/297; 166/299; 181/116; 102/206

[58] Field of Search ..... 166/63, 65.1, 66.5, 166/297, 299; 175/4.54, 4.56; 181/116; 102/206, 312, 330

[56] References Cited

U.S. PATENT DOCUMENTS

| | | | |
|---|---|---|---|
| Re. 31,222 | 4/1983 | McCracken | 364/571 |
| 2,696,259 | 12/1954 | Greene | 166/63 |
| 2,924,173 | 2/1960 | Robertson | 102/20 |
| 3,105,546 | 10/1963 | Ownby | 166/55.1 |
| 3,105,547 | 10/1963 | Ownby | 166/65 |
| 3,105,549 | 10/1963 | Raulins | 166/65 |
| 3,105,550 | 10/1963 | Ehlert | 166/65 |
| 3,176,770 | 4/1965 | Ehlert | 166/55.1 |
| 3,183,972 | 5/1965 | Fredd | 166/35 |
| 3,199,287 | 8/1965 | Kinley | 60/26.1 |
| 3,366,179 | 1/1968 | Kinley et al. | 166/55.3 |
| 3,375,785 | 4/1968 | Moore | 102/20 |
| 3,411,597 | 11/1968 | Kinley et al. | 175/294 |
| 3,447,604 | 6/1969 | Kinley et al. | 166/63 |
| 3,546,478 | 12/1970 | Lindsey | 307/116 |
| 3,570,594 | 3/1971 | Hamilton | 166/64 |
| 3,601,620 | 8/1971 | Gee | 307/41 |
| 3,638,235 | 1/1972 | Lindsey | 346/107 W |
| 3,666,030 | 5/1972 | Bohn et al. | 175/4.56 |
| 3,800,705 | 4/1974 | Tamplen | 102/20 |
| 3,930,449 | 1/1976 | Buchele | 102/70.2 R |
| 3,971,317 | 7/1976 | Gemmell et al. | 102/21 |
| 4,161,782 | 7/1979 | McCracken | 364/571 |
| 4,172,421 | 10/1979 | Regalbuto | 102/20 |
| 4,217,826 | 8/1980 | Young, Jr. et al. | 102/200 |
| 4,266,613 | 5/1981 | Boop | 166/299 |
| 4,306,628 | 12/1981 | Adams, Jr. et al. | 175/4.36 |
| 4,445,435 | 5/1984 | Oswald | 102/215 |
| 4,544,035 | 10/1985 | Voss | 166/299 |
| 4,572,288 | 2/1986 | Kinley | 166/63 |
| 4,614,156 | 9/1986 | Colle, Jr. et al. | 102/312 |
| 4,830,120 | 5/1989 | Stout | 166/298 X |
| 4,886,126 | 12/1989 | Yates, Jr. | 175/4.54 |
| 4,909,320 | 3/1990 | Hebert et al. | 166/55.1 |
| 5,159,146 | 10/1992 | Carisella et al. | 89/1.15 |
| 5,165,489 | 11/1992 | Langston | 175/4.54 |
| 5,188,172 | 2/1993 | Blount et al. | 166/64 |
| 5,191,936 | 3/1993 | Edwards et al. | 166/297 |
| 5,226,494 | 7/1993 | Rubbo et al. | 166/250 |

(List continued on next page.)

OTHER PUBLICATIONS

Brochure, Downhole Triggering Device, Preeminent Energy Services, 1994 or later.

Brochure, Electronic Triggering Device, Halliburton Energy Services, 1994.

Recommended Practices for Oilfield Explosives Safety, API Recommended Practice 67 (RP 67), American Petroleum Institute, First Edition, Mar. 1, 1994.

*Primary Examiner*—Roger Schoeppel
*Attorney, Agent, or Firm*—Pravel, Hewitt & Kimball

[57] ABSTRACT

A self-contained tool incorporates an electronic system for significantly reducing the number of batteries required to detonate an explosive downhole, making the tool short enough for transport by helicopter, rather than by boat, to an offshore well. This shortness is further beneficial for negotiating tight-radius bends in deviated wells. Safety is improved by a shear pin holding a pressure-activated switch in an open position until sufficient pressure shears the shear pin. Control from the surface is provided in applications where fluid pressure is controlled at the surface and raised to shear the shear pin. Longer run-in time is better accommodated by the combination of the electronic system and the shear pin.

21 Claims, 11 Drawing Sheets

U.S. PATENT DOCUMENTS

| | | | |
|---|---|---|---|
| 5,237,136 | 8/1993 | Langston | 200/81 R |
| 5,322,019 | 6/1994 | Hyland | 102/312 |
| 5,343,963 | 9/1994 | Bouldin et al. | 175/27 |
| 5,346,014 | 9/1994 | Ross | 166/297 |
| 5,392,856 | 2/1995 | Broussard, Jr. et al. | 66/285 |
| 5,392,860 | 2/1995 | Ross | 166/376 |
| 5,396,951 | 3/1995 | Ross | 166/63 |
| 5,431,104 | 7/1995 | Barker | 102/312 |
| 5,571,986 | 11/1996 | Snider et al. | 175/4.56 X |

FIG.1
| |
|---|
| FIG. 1A |
| FIG. 1B |
| FIG. 1C |
| FIG. 1D |
FIG.1A
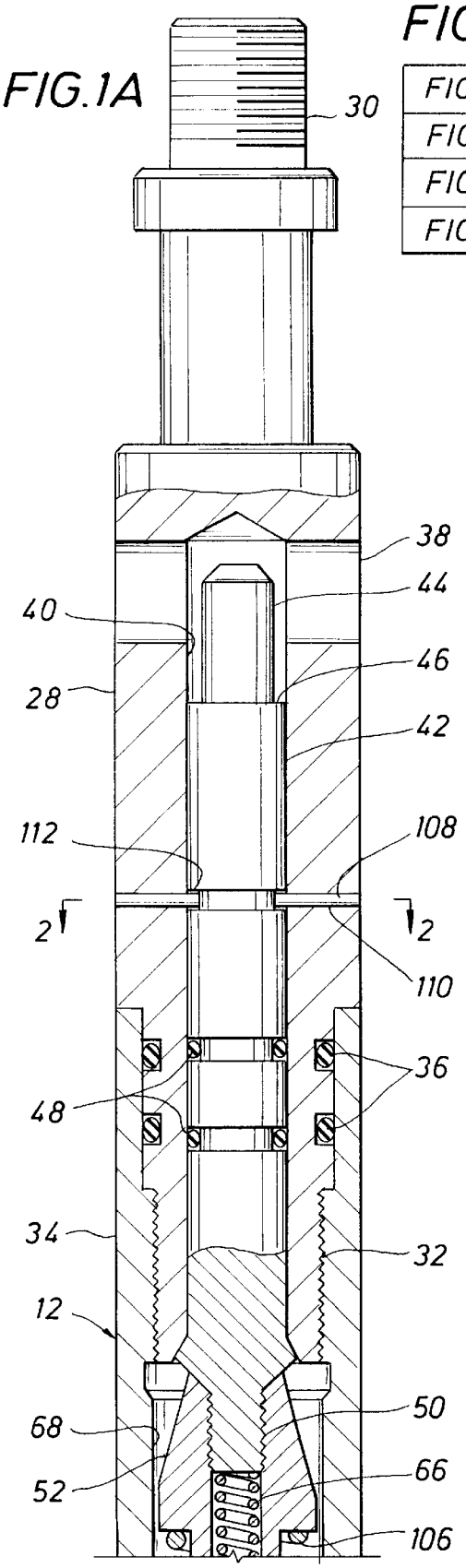
FIG.1B
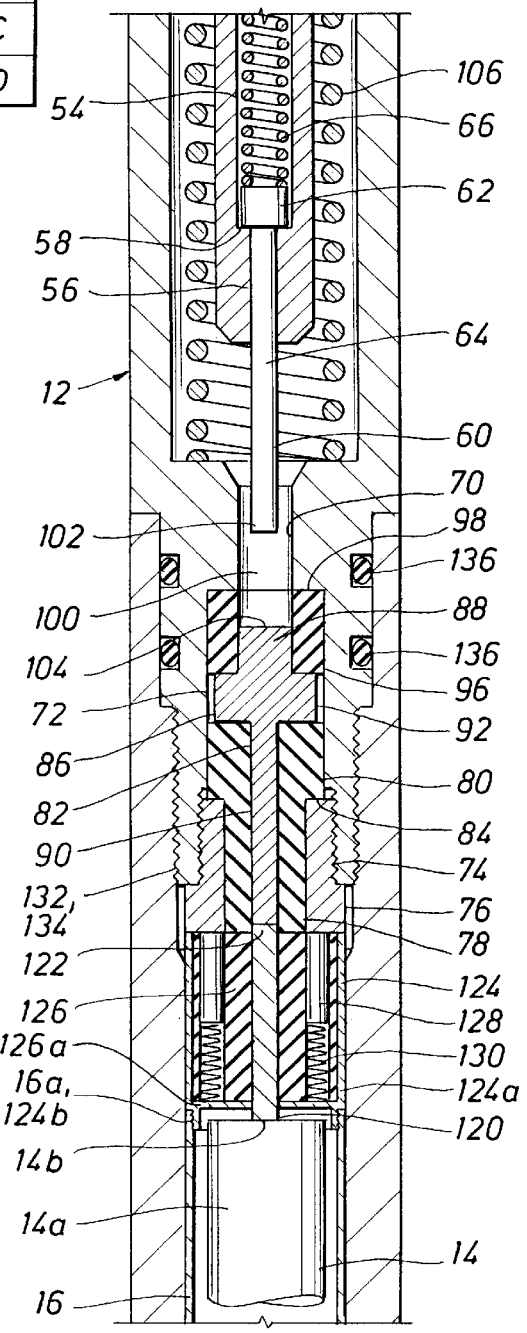

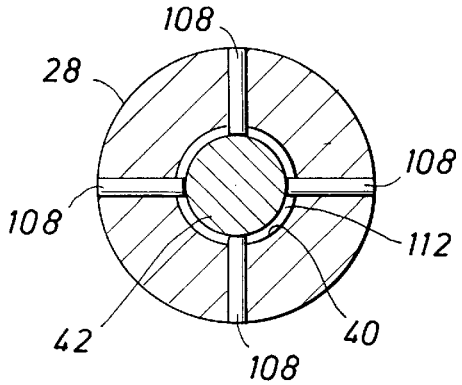
FIG. 2
FIG. 2A
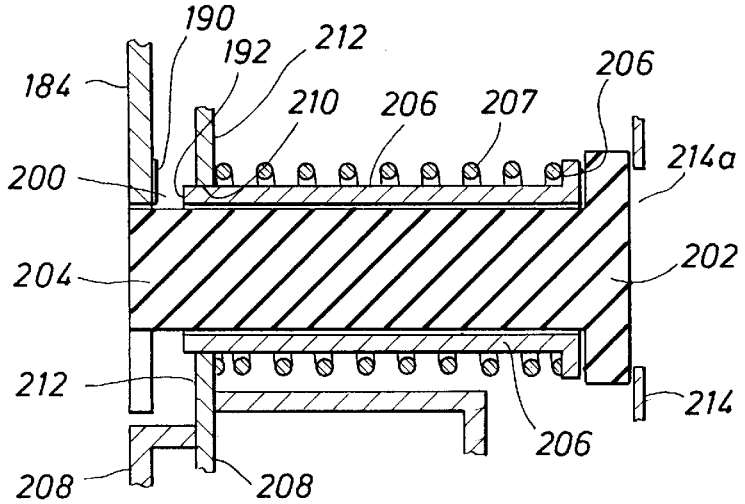
FIG. 4
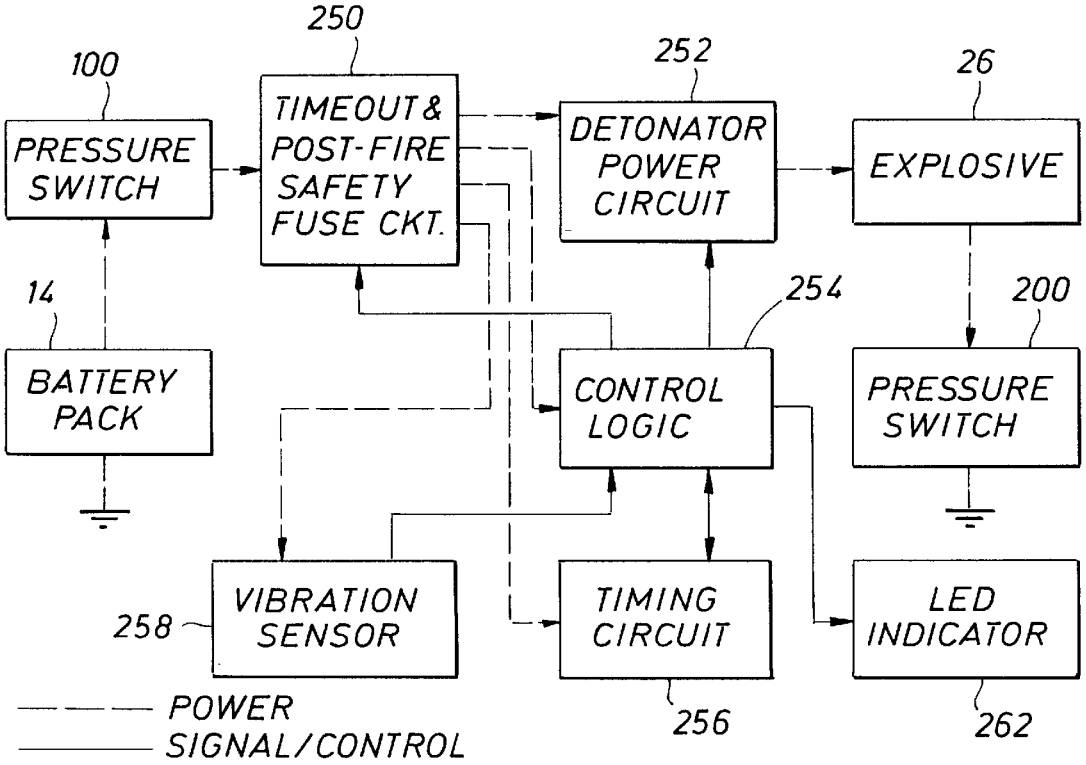

FIG. 3
| |
|---|
| FIG. 3A |
| FIG. 3B |
| FIG. 3C |
| FIG. 3D |
FIG. 3A
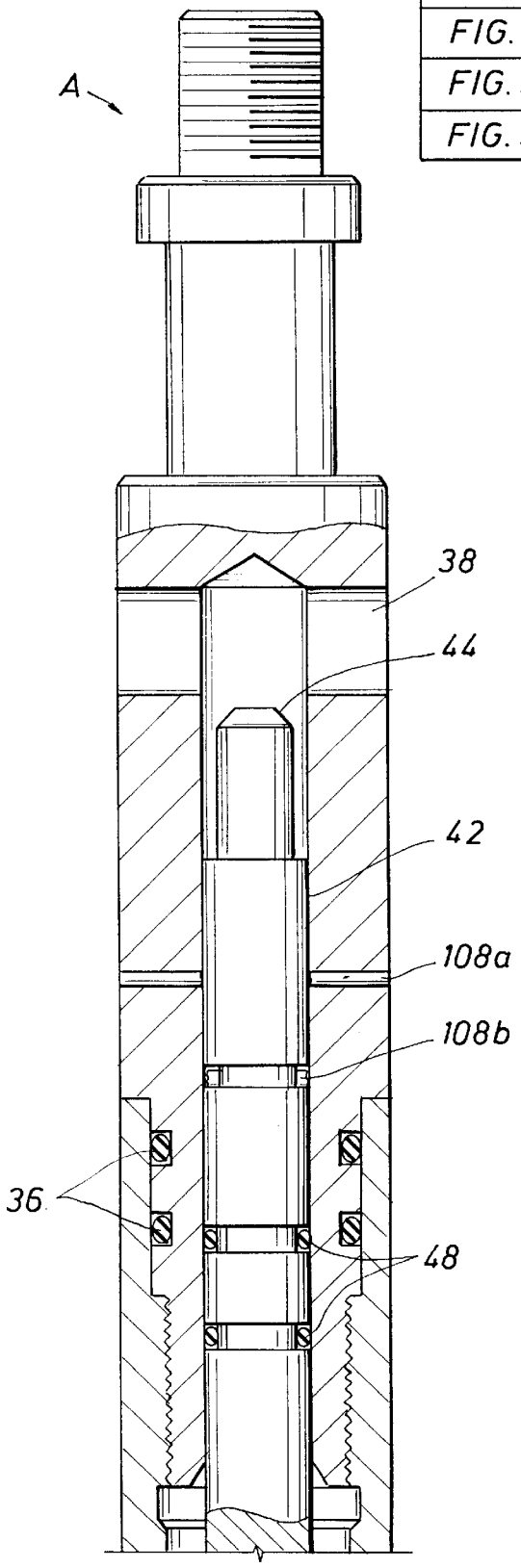
FIG. 3B
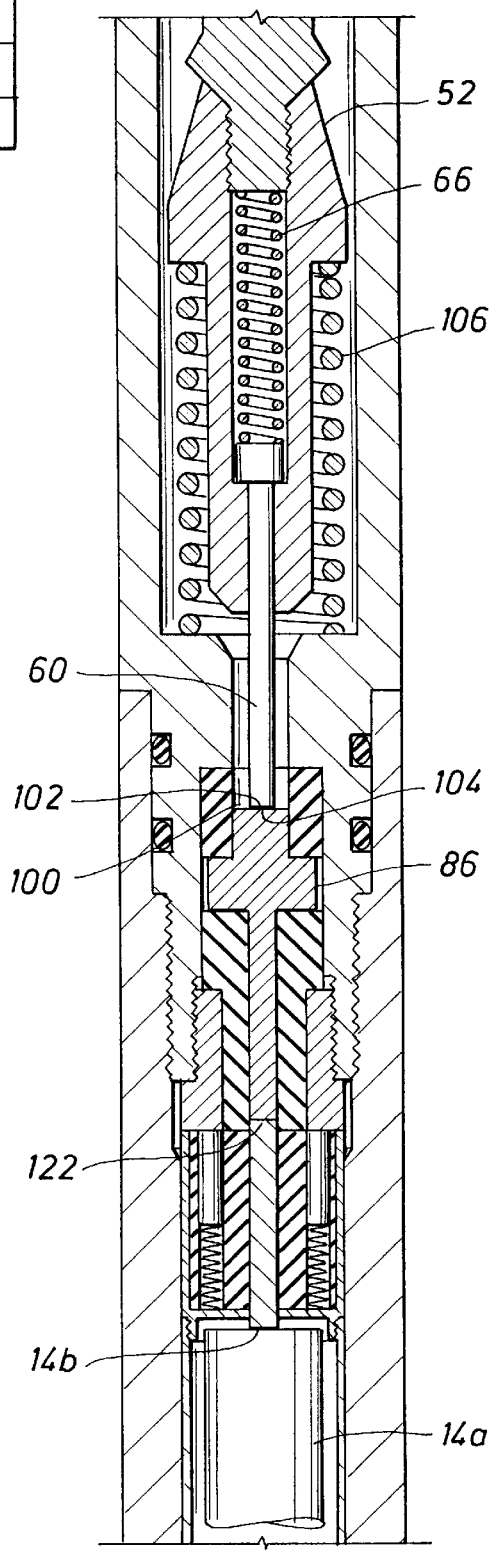

252
252a
486
140
488
484
482
480
478
476
472
474
462
470
464
466
460
468
+7V
BATT-
+5V
454
458
456
452
450
451
449
430
438
437
439
446
432
433
434
436
440
442
444
+5V
FIRE
PWR_CLC

DOWNHOLE TRIGGERING DEVICE

CROSS-REFERENCE TO RELATED APPLICATIONS

Not applicable.

BACKGROUND OF THE INVENTION

1. Field of the Invention

This invention relates in general to oil well tools and in particular to a device for activating an explosive downhole.

2. Description of the Related Art

Explosives are set off downhole in an oil or gas well for various purposes including, for example, perforating a casing, cutting a wire line or setting a packer. Numerous patents have addressed the subject of conveying an explosive safely downhole and detonating the explosive at a desired location.

Detonating devices have frequently been conveyed into a well bore on an electric wire line. An electric wire line offers the advantage of providing control of the tool from the surface. However, there are disadvantages to using an electric wire line, including the expense of setting up and deploying the wire line. Further, deviated or horizontal wells are being drilled more frequently now, and gravity cannot be relied upon to deploy a tool into a horizontal well. Coiled tubing may be required to push a tool into a desired position in a horizontal well bore.

Where a tool can be lowered into a well bore, the use of a non-electric or "slick" wire line is preferable in that it is more economical. U.S. Pat. No. 4,306,628, issued to Adams, Jr. et al. exemplifies the prior art for a mechanical switch that can be deployed on a slick wire line and yet be controlled from the surface. Adams, Jr. et al. disclose a mechanical safety switch for closing electrical contacts in a well tool. The mechanical switch has several safety requirements which must be satisfied before electrical contacts will close, including upward pull on a wire line and sensing a preselected value of fluid pressure in the well bore. The tool incorporates a motion sensor and a timer in a circuit, the circuit including a mechanical switch that is closed by upward pull on the wire line for activating an explosive device.

The Adams, Jr. et al. device has a trigger that extends laterally from the tool so as to contact the inside wall of a cased well bore. When the device is lowered to a proper depth, an operator at the surface pulls upwardly on the slick wire line. The trigger should catch on the inside wall of the casing when the tool is pulled upwardly so that the trigger is pulled into a second position, closing a set of electrical contacts and enabling a circuit.

Difficulties were experienced with this mechanical apparatus. The tool was subsequently modified to eliminate the trigger mechanism activated by upward pull on the wire line. Well pressure was instead used to close an electrical switch, with well pressure moving a piston longitudinally within the tool. Unfortunately, these modifications led to an incident where debris was trapped on the piston leaving the electrical switch in a closed position. When an operator at the surface reloaded an explosive charge, the switch was closed, activating the explosive and injuring the operator severely.

The American Petroleum Institute developed Recommended Practice 67 for handling oilfield explosives safely. Section 4.3 of Recommended Practice 67 states that detonators and initiators must incorporate at least one of the following features: a minimum DC resistance of 50 ohms with a minimum "no-fire" current of 200 milliamperes; a high voltage exploding bridgewire design; a high voltage exploding foil initiator design; or a system offering equivalent safety.

The high voltage exploding bridgewire design and the high voltage exploding foil initiator design require a high-voltage charge for activation. A tool conveyed downhole by a slick wire line or coiled tubing includes a self-contained power supply, typically a battery pack. Consequently, tools conveyed by slick wire line or coiled tubing typically do not use the high voltage exploding bridgewire or foil initiator design because a self-contained power supply typically cannot provide sufficiently high voltage. Tools conveyed by a slick wire line or coiled tubing typically incorporate a design including a minimum DC resistance of 50 ohms with a minimum "no fire" current of 200 milliamperes.

Halliburton Energy Services, Inc. provides an electronic triggering device for setting various explosive-powered tools and charges without the use of a conductor line. The device can be run on a mechanical slick line, braided line or sand line, and the tool is used for multi-shot perforating, cutting tubing or casing, setting bridge plugs or packers and other services including dump baler, string shot and patching tubing or casing. The device is battery powered, sensitive to motion, and has two pressure-activated switches. The pressure-activated switches are closed typically at a depth of about 300 feet by fluid pressure. Thus, the pressure-activated switches provide a safety feature to prevent an explosion on or near the surface. After the pressure-activated switches are closed, a motion sensor prevents detonation as long as the motion sensor detects motion.

Although Halliburton's electronic triggering device represents the state of the prior art, it has several deficiencies. This prior art triggering device relies entirely on a motion sensor to prevent detonation after the pressure-activated switches are closed, and a motion sensor does not provide a fully predictable detonation, particularly in a horizontal well. Where run-in time is lengthy, due to possibly the depth of the well or the use of coiled tubing which is run in relatively slowly, an operator must rely on the motion sensor for an extended period of time to prevent detonation. If the prior art triggering device has a timeout circuit for deactivation after a predetermined period of time, then a long run-in time may cause the device to deactivate prematurely or the period of time must be set relatively long, sometimes resulting in unnecessary delay.

Safety is a her concern because the triggering device is sometimes placed inside a lubricator in a well at the surface, where it can encounter sufficient pressure to close the pressure-activated switches which activates the tool. The triggering device then must be lowered before a timer allows it to explode. On information and belief a further deficiency is that the prior art triggering device cannot be controlled from the surface.

Implementation of the recommendations of the American Petroleum Institute in its Recommended Practice 67 created another deficiency. The prior art triggering device uses a large number of batteries to meet the current and voltage requirements to detonate an explosive, so many batteries that the tool is necessarily very long. Although the prior art tool disassembles into sections, the longest section is so long (due to the large number of batteries) that it cannot be positioned in or transported by helicopter, which is a preferred means of transportation for equipment and personnel to offshore oil and gas wells. The long length of the prior at triggering device is also undesirable because it limits the angle that can be drilled between a vertical and horizontal run in a deviated well, since the tool cannot pass through a tight radius bend.

SUMMARY OF THE INVENTION

The present invention provides a downhole triggering device that does not have the above-noted deficiencies. Although the present invention also uses two pressure-activated switches and a motion sensor, it includes a shear pin to hold one of the pressure-activated switches open until sufficient pressure is encountered to sever the shear pin. This improves the safety of this explosive detonating device, referred to herein as the downhole triggering device. By using one or more shear pins, the downhole triggering device will not be activated by pressures encountered in a lubricator at the surface of a well. In a deep well or in a horizontal well, the shear pins delay activation so that the motion sensor is not relied upon for an extended period of time, and the number of shear pins used is adjustable depending on the requirements for a particular application. In certain applications the downhole triggering device does not encounter sufficient pressure to shear the shear pins. In these applications an operator can pump fluid into the well bore to raise the pressure sufficiently to sever the shear pins, which gives control from the surface.

In another aspect the present invention provides an electronic system capable of detonating an explosive according to the recommendations of the American Petroleum Institute's Recommended Practice 67 using merely five 1.5 volt C-cell batteries. With so few batteries requiring space, the downhole triggering device disassembles into sections short enough to meet the requirements for helicopter transport. This allows the downhole triggering device to be transported quickly and cost effectively to an offshore well site, while the prior art triggering device must be transported by boat, a much slower, and thus more costly, means for shipment. Further, the shortness of the downhole triggering device is advantageous in that it can negotiate tight radius bends between vertical and horizontal runs in a deviated well.

The combination of the shear pins and shortness of the downhole triggering device achieved by circuitry requiring merely five C-cell batteries is particularly advantageous for detonating an explosive in a horizontal well. Coiled tubing is used in a horizontal well, and coiled tubing must be run in more slowly than wireline. The lengthy run-in time for coiled tubing can be accommodated by using shear pins to delay activation of the downhole triggering device. The shorter downhole triggering device negotiates a sharper angle than does the longer prior art triggering device. Thus, deviated wells can be drilled with tighter radius bends, and the downhole triggering device can be used in these wells.

BRIEF DESCRIPTION OF THE DRAWINGS

A better understanding of the present invention can be obtained when the following detailed description is considered in conjunction with the following drawings, in which:

FIG. 1 is a longitudinal cross section of a downhole triggering device with electrical contacts in an open position, according to the present invention;

FIG. 1A is a longitudinal cross section of an upper portion of a top switch for the downhole triggering device of FIG. 1;

FIG. 1B is a longitudinal cross section of a lower portion of the top switch of FIG. 1A;

FIG. 2 is a transverse cross section of the downhole triggering device of FIG. 1 as seen along the lines 2—2, illustrating shear pins used to hold the electrical contacts in an open position;

FIG. 2A is an enlargement of a portion of FIG. 1, illustrating a lower switch;

FIG. 3 is a longitudinal cross section of the downhole triggering device of FIG. 1 with the electrical contacts in a closed position;

FIG. 3A is a longitudinal cross-section of an upper portion of a top switch for the downhole triggering device of FIG. 3;

FIG. 3B is a longitudinal cross section of a lower portion of the top switch of FIG. 3A;

FIG. 4 is a simplified block diagram illustrating electrical components and control logic for the downhole triggering device of FIG. 1;

DETAILED DESCRIPTION OF THE PREFERRED EMBODIMENT

Figure 1C:
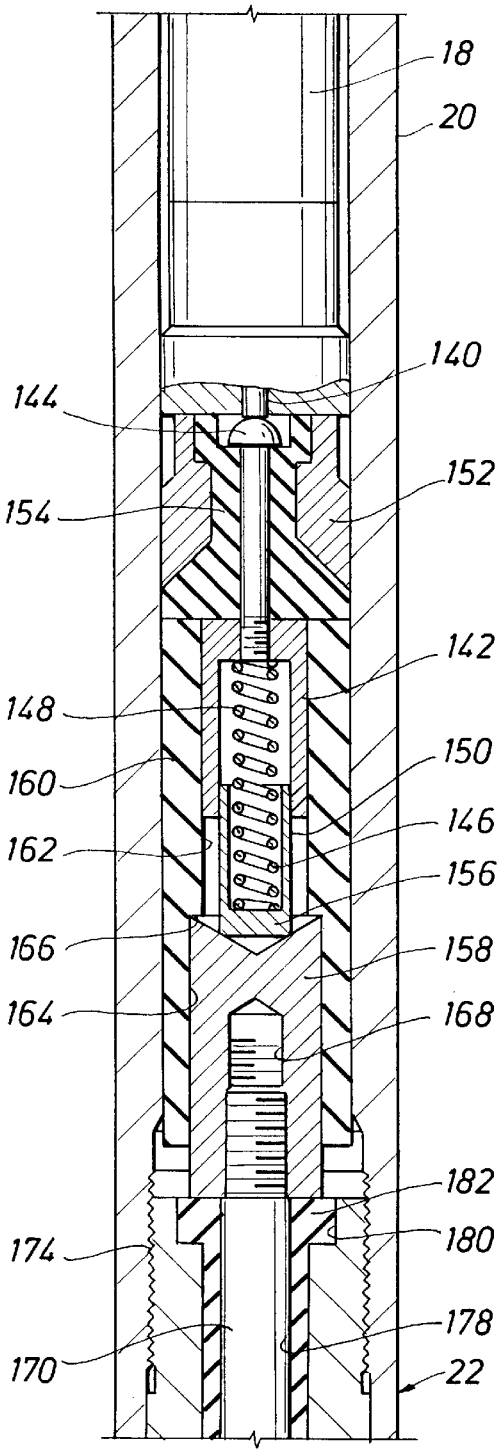
FIG. 1C is a longitudinal cross section of an upper portion of a bottom switch of the downhole triggering device of FIG. 1.

With reference FIGS. 1A, 1B, 1C, and 1D a downhole triggering device A is illustrated in longitudinal cross section. Downhole triggering device A includes a top switch 12 which can be in electrical contact with a battery pack 14. Battery pack 14 is in electrical contact with electronics 18, and battery pack 14 and electronics 18 are enclosed in a barrel 16. Barrel 16 is enclosed in a timer housing 20. A bottom switch 22 engages timer housing 20 at its upper end 140 and a firing head 24 at a lower end. Top switch 12 and bottom switch 22 are incorporated in a circuit with battery pack 14 to provide current to firing head 24 for detonating an explosive 26. Because U.S. Pat. No. 4,306,628, issued to Adams, Jr. et al., describes a similar device for detonating an explosive, it is incorporated by reference for all purposes.

Considering top switch 12 in more detail, a top subassembly 28 (FIG. 1A) has a threaded end 30 for engagement with a slick non-electrical wireline or coiled tubing for lowering downhole triggering device A into a well bore (not shown). Top subassembly 28 has male threads 32 in threaded engagement with a pressure subassembly 34. O-ring seals 36 provide a tight seal between top subassembly 28 and pressure subassembly 34. Top subassembly 28 has a lateral opening 38 through it. Top subassembly 28 has a bore 40 extending longitudinally through it. A top piston 42 is slidably disposed within bore 40, and it has an upper end 44. When downhole triggering device A is lowered into a well bore, a shoulder 46 on end 44 senses pressure in the well bore through opening 38. Thus, opening 38 provides fluid communication for pressure sensing within the well bore by top piston 42, pressure acing on shoulder 46 and upper end 44. Top piston 42 is sealed within bore 40 by O-ring seals 48.

Figure 3C:
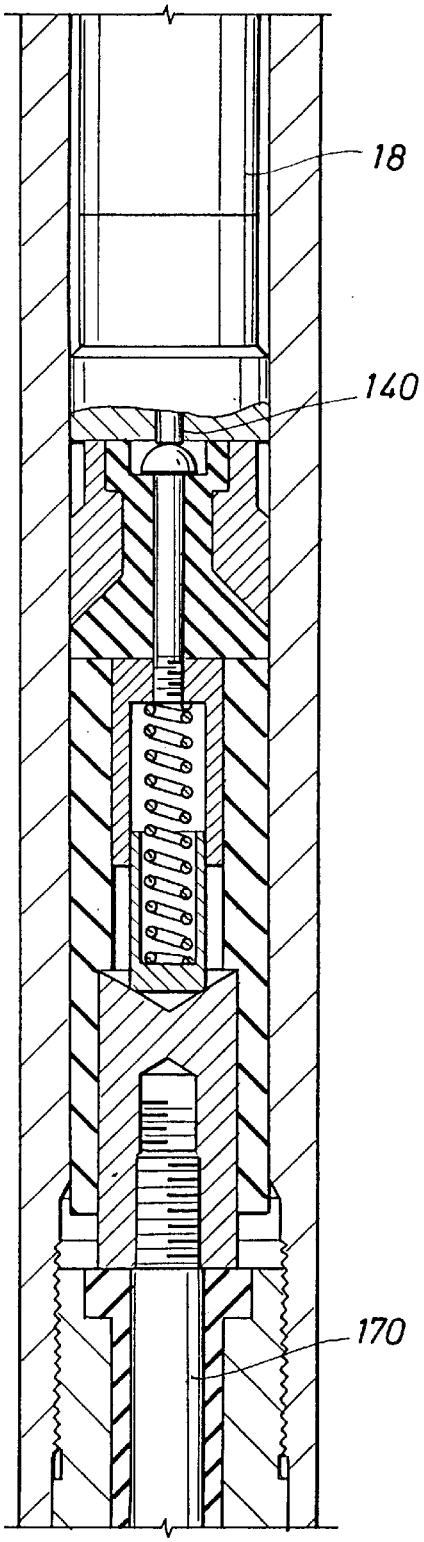
FIG. 3C is a longitudinal cross section of an upper portion of a bottom switch of the down hole triggering device of FIG. 3.

Top piston 42 has a lower end 50, which has male threads for a threaded connection to a dart adapter 52. Dart adapter 52 has a longitudinal bore through its entire length, and the bore includes a wide bore 54 and a narrow bore 56 therebelow providing a shoulder 58. A single shoulder dart 60 having a head 62 extends through wide bore 54, with head 62 engaging shoulder 58 while a shank 64 of dart 60 extends through narrow bore 56. A spring 66 is positioned in wide bore 54 and engages head 62 of dart 60. Spring 66 holds dart 60 in an extended position (FIG. 1B), yet allows dart 60 to retract by compressing spring 66 (FIG. 3B).

Pressure subassembly 34 has a bore throughout its full length including a wide bore 68, a narrow bore 70 and an intermediate bore 72. Intermediate bore 72 has female threads 74 for receiving an adjustable nut 76. Nut 76 has a longitudinal bore 78 throughout its entire length. An electrically nonconductive insulator 80 fits within bore 78 and intermediate bore 72 and has a longitudinal bore 82 and a shoulder 84. Nut 76 engages shoulder 84 so that insulator 80 cannot slide through bore 78 of nut 76.

A double shoulder dart 86 having a head 88, a shank 90 and shoulders 92 fits in intermediate bore 72 of pressure subassembly 34 without making electrical contact with pressure subassembly 34 (FIG. 1B). Stank 90 of double shoulder dart 86 fits in bore 82 of insulator 80 so that shoulders 92 rest on a top end of insulator 80. An annular insulator 96 fits about head 88 of double shoulder dart 86. Annular insulator 96 rests against a shoulder 98 formed at the interface between intermediate bore 72 and narrow bore 70 of pressure subassembly 34.

An upper switch 100 includes a first electrical contact 102 and a second electrical contact 104. A circuit is closed by engaging first electrical contact 102 with second electrical contact 104, closing upper switch 100. A spring 106 holds first electrical contact 102 in disengagement from second electrical contact 104, keeping upper switch 100 in an open position until pressure on upper end 44 and shoulder 46 through opening 38 forces top piston 42 downward, compressing spring 106 and closing upper switch 100.

Top switch 12 is assembled by first making up top subassembly 28, next making up pressure subassembly 34, next placing spring 106 in wide bore 68, and finally threading pressure subassembly 34 onto threads 32 of top subassembly 28 with O-ring seals 36 in place for sealing bore 68 and bore 70 from fluid in a well bore.

The operation of top switch 12 of downhole triggering device A is described as follows. While at the surface or while running the device A into a well bore, upper switch 100 is open, because first electrical contact 102 is spaced apart from second electrical contact 104. In a downhole position, fluid pressure acts on upper end 44 and shoulder 46 of top piston 42 through opening 38 of top subassembly 28. Spring 106 is sized so that a predetermined amount of pressure is required to compress spring 106. When this desired pressure acts on upper end 44 and shoulder 46 of top piston 42, top piston 42 slides downwardly through bore 40 until first electrical contact 102 touches second electrical contact 104 and closes upper switch 100. Spring 66 is sized to put a constant force on second electrical contact 104 through single shoulder dart 60 so that insulator 80 is not broken by high pressure. Thus, at high pressures both spring 66 and spring 106 compress so that top piston 42 does not overstress insulator 80.

When upper switch 100 is closed, first electrical contact 102 touching second electrical contact 104, a conductor path is provided between top switch 12, timer housing 20 and bottom switch 22. The housing of downhole triggering device A provides a conductor path for completing the circuit.

Shear pins 108 pass through drilled holes 110 in top subassembly 28 and engage a groove 112 in top piston 42 (FIGS. 1 and 2). Shear pins 108 hold top piston 42 in a fixed position, holding upper switch 100 in an open position. Shear pins 108 are sized to shear at a much greater pressure than is required to compress spring 106. By using shear pins 108, device A can be lowered into a well bore and fluid pressure operating on top piston 42 does not close upper switch 100 until the fluid pressure in the well is much higher than is required to compress spring 106. Thus, device A can be lowered to a greater depth before upper switch 100 is closed because shear pins 108 hold top piston 42 in a fixed or latched position.

In a preferred embodiment, spring 106 is designed to allow upper switch 100 to be closed by a pressure of 150 psig, while a single shear pin 108 is typically designed to require a pressure of 1,300 psig to sever shear pin 108 so that upper switch 100 is closed. Downhole triggering device A does not require shear pins 108 for operation, but it is desirable, to use shear pins 108 in certain applications. Multiple shear pins 108 are used to hold switch 100 open against higher pressures so that triggering device A can be lowered to greater depths before encountering sufficient shear force. The required shear force is additive so that the force required to sever two shear pins 108 is about twice that required to sever one shear pin 108.

When the downhole triggering device A is in a closed or firing position, spring 106 is compressed as top piston 42 has moved downwardly so that dart 60 and its first electrical contact 102 are touching double shoulder dart 86 and its second electrical contact 104. Spring 66 holds a constant compressive force on dart 60 and dart 86 so as to prevent disintegration of electrical insulator 80. O-ring seals 36 and 48 prevent fluid communication into upper switch 100, allowing upper switch 100 to remain clean and dry.

Battery pack 14 is placed in a circuit with upper switch 100 through a hot lead 120. Hot lead 120 is in electrical contact with second electrical contact 104 through double shoulder dart 86 with shank 90 touching an upper end 122 of hot lead 120. A battery contact case 124 encloses an insulator 126. Insulator 126 has three longitudinal bores, including a hot lead bore **120*a* through which hot lead 120 passes. Two ground leads 128 are provided for providing a ground connection between nut 76 and battery contact case 124. Insulator 126 has two bores 128*a* for receiving ground leads 128. Springs 130 are placed in ground lead bores 128*a*, forcing ground leads 128 in contact with nut 76. Battery contact case 124 has a lower end 124*a*, and springs 130 provide electrical contact between ground leads 128 and lower end 124*a*. Insulator 126*a* electrically insulates hot lead 120 from battery contact case 124**.

Battery contact case 124 has male threads **124*b* which receive female threads 16*a* of barrel 16. A battery 14*a* has a terminal 14***b* in electrical contact with hot lead 120. Battery pack 14 preferably includes five C-cell batteries providing a nominal 7.5 volts.

Pressure subassembly 34 has male threads 132, and timer housing 20 has female threads 134 for engaging male threads 132. Two O-ring seals 136 provide a fluid-tight seal between timer housing 20 and pressure subassembly 34 when threads 134 are engaged with threads 132.

With timer housing 20 engaged with pressure subassembly 34, electrical contact is established from second electrical contact 104 through dart 86, through hot lead 120 to terminal 14*b* of battery 14*a*. Battery pack 14 has five "C" cell batteries in series, which terminate at a terminal 14*c* (not shown). Terminal 14*c* provides a hot lead to electronics 18.

Figure 3D:
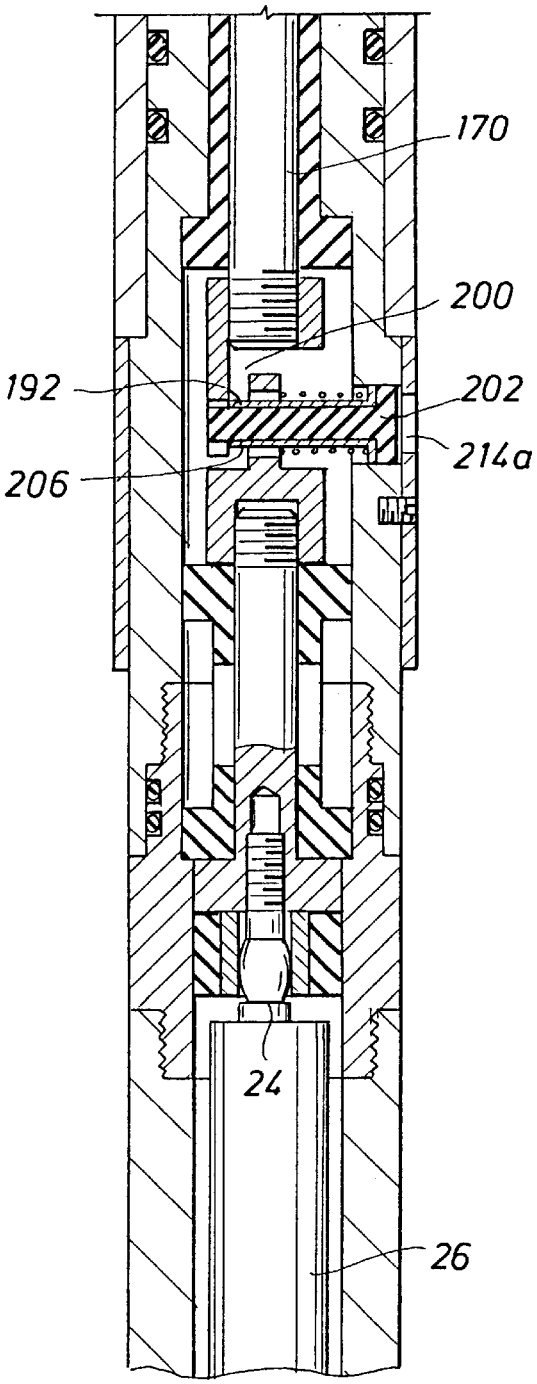
FIG. 3D is a lower portion of the bottom switch of FIG. 3C.

Electronics 18 shown schematically in FIGS. 1 and 3, is in a common circuit with upper switch 100, battery pack 14 and the housing (including 20, 28, 34, 172 and 230) of do device A. Electronics 18 terminates at its lower end in a contact prong 140 (FIG. 1C). A lower contact 142 is in electrical contact with contact prong 140. Lower contact 142 has a screw contact 144 which touches contact prong 140 providing a closed circuit between electronics 18 and lower contact 142. Screw contact 144 threads into a lower spring contact 146 (FIG. 1C) which includes a spring 148 and a telescoping portion 150. Spring 148 places a compressive force upwardly between contact prong 140 and screw contact 144. Screw contact 144 is enclosed in a lower contact case 152. Insulators 154 electrically insulate screw contact 144 from lower contact case 152.

Lower spring contact 146 has a lower end 156 which is in physical contact with an upper rod contact 158. Lower spring contact 146 and upper rod contact 158 are enclosed in an electrical insulator 160. Insulator 160 is cylindrical and has a narrow bore 162 and a wider bore 164 forming a shoulder 166 between them. Insulator 160 insulates lower spring contact 146 and upper rod contact 158 from timer housing 20. Upper rod contact 158 has a threaded bore 168. An upper through rod contact 170 threads into threaded bore 168, providing an electrical conductor from contact prong 140 through upper through rod contact 170.

An upper housing 172 has male threads 174 for threading into and connecting with timer housing 20. O-ring seals 176 provide a fluid-tight seal between timer housing 20 and upper housing 172 of bottom switch 22. Upper housing 172 has a longitudinal bore 178 for receiving upper through rod contact 170. Upper housing 172 has a counterbore 180 for receiving an electrical insulator 182 which centers upper through rod contact 170 in longitudinal bore 178.

Figure 1D:
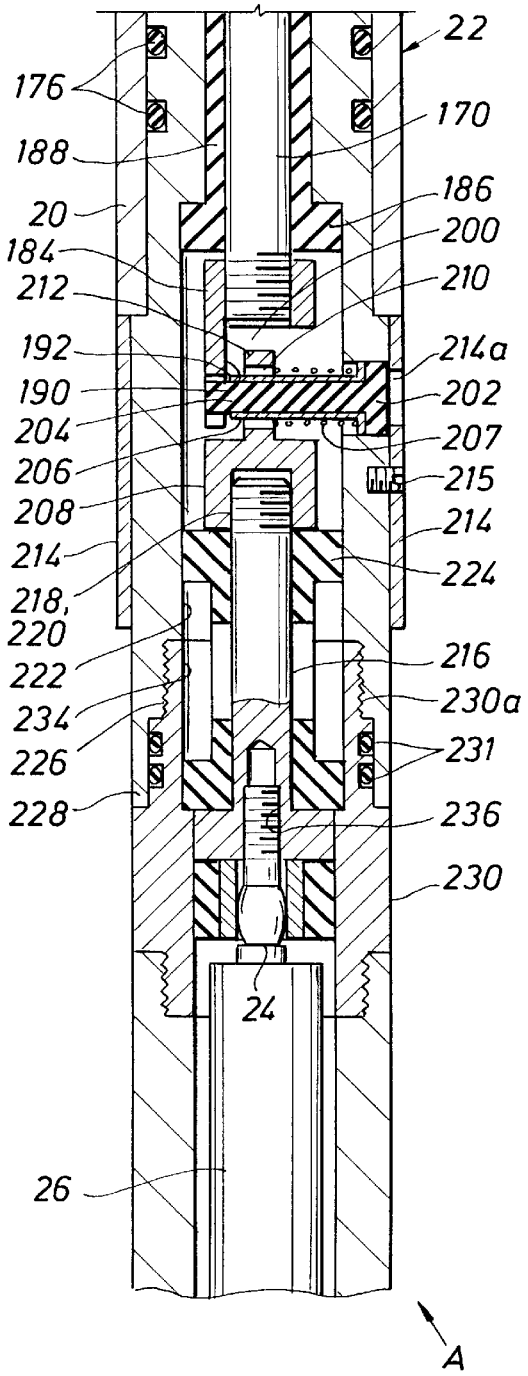
FIG. 1D is a lower portion of the bottom switch of FIG. 1C.

Upper through rod contact 170 terminates at its lower end in a fork 184 (FIG. 1D). An insulator 186 fits around upper through rod contact 170, holding contact 170 concentric with longitudinal bore 178. A cylindrical insulator 188 fits in the annular space between upper through rod contact 170 and bore 78, electrically insulating contact 170 from upper housing 172.

As best seen in FIG. 2A, fork 184 provides a third electrical contact 190. A fourth electrical contact 192 opposes third electrical contact 190 for providing a lower switch 200. Lower switch 200 is closed by pressure sensed by a switch piston 202, which moves laterally in upper housing 172. Switch piston 202 is enclosed by an insulator 204. A switch contact 206 surrounds and encloses insulator 204. Switch contact 206 contains fourth electrical contact 192 at one end. A spring 207 holds switch contact 206 in an open position, until enough fluid pressure acts on switch piston 202 to compress spring 207 enough to close lower switch 200 by touching fourth electrical contact 192 against third electrical contact 190.

A lower contact rod adapter 208 has an oblong hole 210 in a finger 212. An insulator 213 (not shown for clarity) fits about finger 212, electrically insulating finger 212 from fork 184 of upper through rod contact 170. Switch piston 202 and insulator 204 fit through oblong hole 210 in finger 212 of lower contact rod adapter 208. Switch con 206 is in conductive contact wit lower contact rod adapter 208. A piston sleeve protector 214 holds switch piston 202 in position, and a screw 215 holds piston sleeve protector 214 in position. Piston sleeve protector 214 is cylindrical and fits around upper housing 172.

A lower through rod contact 216 has threads 218 for engaging a threaded bore 220 in lower contact rod adapter 208. Lower through rod contact 216 is in electrical contact with fourth electrical contact 192 of switch contact 206. Upper housing 172 has a lower bore 222, and an insulator 224 electrically insulates lower contact rod adapter 208 and lower through rod contact 216 from upper housing 172. Upper housing 172 has female threads 226 at its lower end 228.

A lower housing 230 of bottom switch 22 has male threads 230*a* for engaging the female threads 226 of upper housing 172. O-ring seals 231 provide a fluid-tight seal between upper housing 172 and lower housing 230 of bottom switch 22. An insulator 232 holds lower through rod contact 216 in a bore 234 provided in lower housing 230. Firing head 24 threads into a threaded bore 236 provided in a lower end 238 of lower through rod contact 216.

In operation, switch piston 202 senses pressure in a well bore through a hole 214*a* provided in piston sleeve protector 214. Spring 207, provided around insulator 204 which is around switch piston 202, is sized to be compressed by a predetermined well-bore pressure. When pressure in the well bore exceeds this predetermined pressure, the pressure in the well bore compresses spring 207 and slides switch contact 206 laterally (to the left as viewed in FIG. 1) so that fourth electrical contact 192 touches third electrical contact 190 closing lower switch 200. With lower switch 200 in a closed position, a circuit is established between contact prong 140 of electronics 18 and firing head 24 which is attached to lower through rod contact 216. When current is provided to firing head 24 a circuit is established through explosive 26. Current flows through explosive 26 to ground provided by lower housing 230, upper housing 172, timer housing 20, pressure subassembly 34 and top subassembly 28. If upper switch 100 and lower switch 200 are both in a closed position, then electronics 18 can provide electrical voltage/current to firing head 24 to detonate explosive 26.

U.S. Pat. No. 5,237,136, issued to Langston, teaches an alternate arrangement for bottom switch 22 and is incorporated by reference for further information regarding pressure-activated switches.

Turning to FIGS. 3A, 3B, 3C, and 3D which show the tool of FIG. 1 in the firing position, downhole triggering device A is shown with upper switch 100 (FIG. 3B) and lower switch 200 (FIG. 3D) in a closed position. Shear pins 108 have been sheared into portions 108*a* and 108*b* by pressure acting on top piston 42. After use, downhole triggering device A can be withdrawn to the surface and shear pin portions 108*a* and 108*b* can be removed and new shear pins 108 can be installed, readying downhole triggering device A for reuse.

Downhole triggering device A can be used without shear pins 108 although it then lacks the additional safety and operational features of this invention which are extremely important in an explosive-actuated tool. In such modified mode of operation, spring 106 holds first electrical contact 102 spaced apart from second electrical contact 104 until sufficient pressure is sensed by top piston 42 on upper end 44 and shoulder 46 to compress spring 106. When the pressure in the well bore exceeds the resistive force of spring 106, then spring 106 compresses allowing first electrical contact 102 to move downwardly until it touches second electrical contact 104 and closes upper switch 100.

Lower switch 200 has also been closed by pressure sensed downhole. Downhole pressure is in fluid communication with switch contact 206 through opening 214*a* in piston sleeve protector 214. Pressure has moved switch piston 202 laterally, compressing spring 207 and moving fourth electrical contact 192 laterally. Sufficient pressure moves fourth electrical contact 192 laterally until it touches third electrical contact 190, closing lower switch 200. Spring 207 is sized to compress at a desired predetermined pressure, so that switch piston 202 moves laterally and compresses spring 207 when well-bore pressure exceeds the desired predetermined pressure. Alternatively, shear pins 108 can be used in conjunction with switch piston 202.

When both upper switch 100 and lower switch 200 are closed, an electrical circuit is established through battery pack 14, electronics 18, upper through rod contact 170, lower through rod contact 216, and firing head 24 to detonate explosive 26 by providing a current through explosive 26 to ground. Ground is provided by the various housings, including 230, 172, 20, 34 and 28. The ground circuit is completed through upper switch 100 from top subassembly 28 to battery terminal 14*b*.

Turning now to FIG. 4, a block diagram is provided, illustrating the functionality of downhole triggering device A. Upper switch 100 provides a switch between battery pack 14 and a timeout and post-fire safety fuse circuit 250. Lower switch 200 provides a switch between explosive 26 and ground. When both upper switch 100 and lower switch 200 are closed, power passes through timeout and post-fire safety fuse circuit 250 to a detonator power circuit 252, control logic 254, a timing circuit 256, and a vibration sensor 258. From the detonator power circuit 252, power is provided to detonate explosive 26, completing a circuit to ground through lower switch 200.

Figure 5:
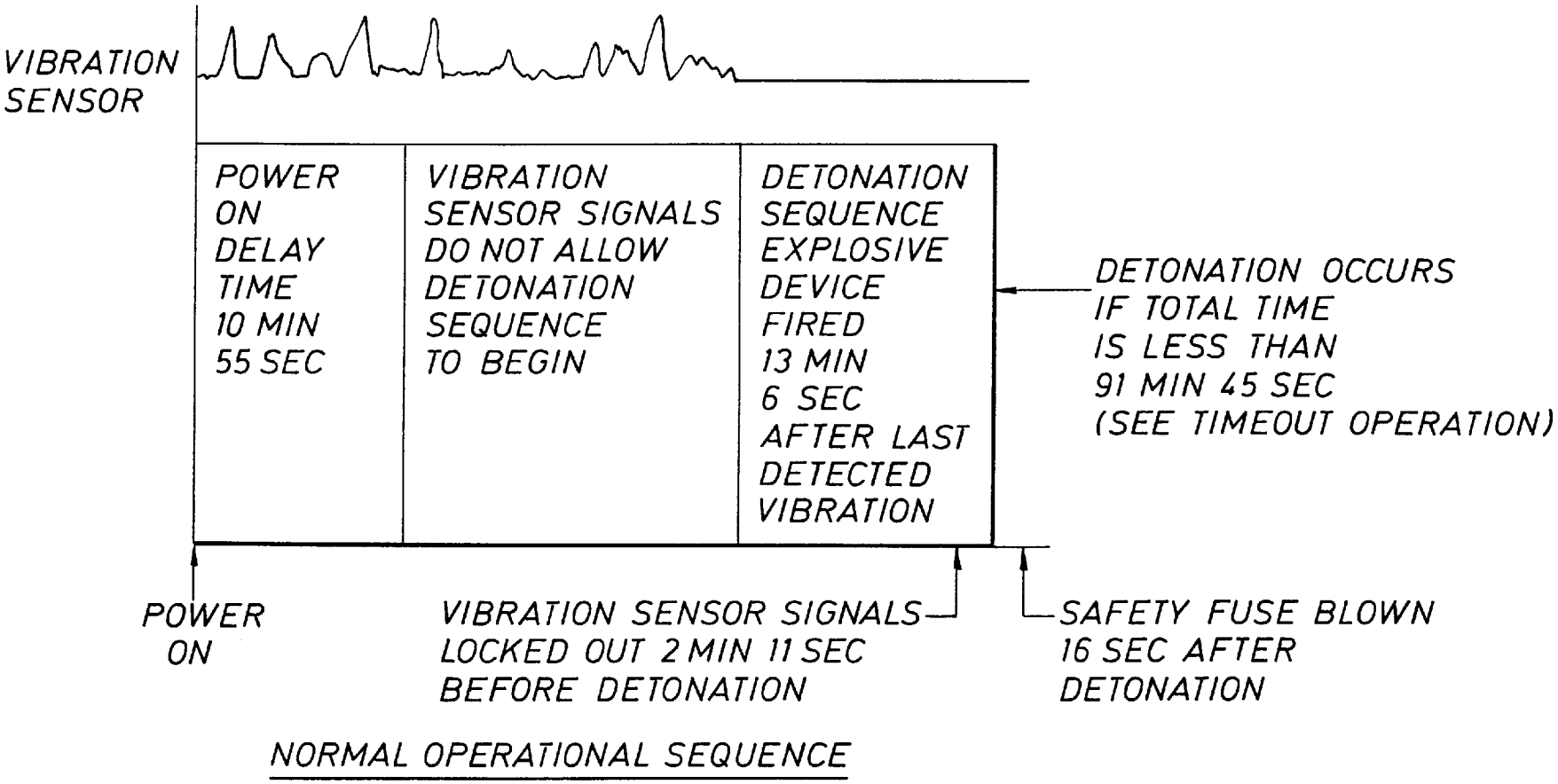
FIG. 5 is a chart illustrating a normal operational sequence of the downhole triggering device of FIG. 1.

Control logic 254 provides control signals to timeout and post-fire safety fuse circuit 250, detonator power circuit 252, timing circuit 256, vibration sensor 258, and a light emitting diode 262. Functionality is explained with reference to FIGS. 5 and 6. A normal operational sequence is illustrated in FIG. 5, where time is depicted on a horizontal axis and an event is depicted on a vertical axis. Power is turned on when both upper switch 100 and lower switch 200 are closed, indicated as "Power On" in FIG. 5. Time is accumulated, and explosive 26 cannot be detonated for a minimum of 10 minutes and 55 seconds following "Power On". After this initial delay, vibration sensor 258 prevents a detonation sequence from beginning until at least 13 minutes and 6 seconds lapses without detection of vibration by vibration sensor 258. Power is applied to explosive 26 for detonation after 13 minutes and 6 seconds have lapsed without detection of vibration by vibration sensor 258, provided total lapsed time from power up is less than 91 minutes and 45 seconds. After detonation, with a post 16 second lapse of time, a safety fuse 400 is blown so that downhole triggering device A can be safely withdrawn to the surface.

Figure 6:
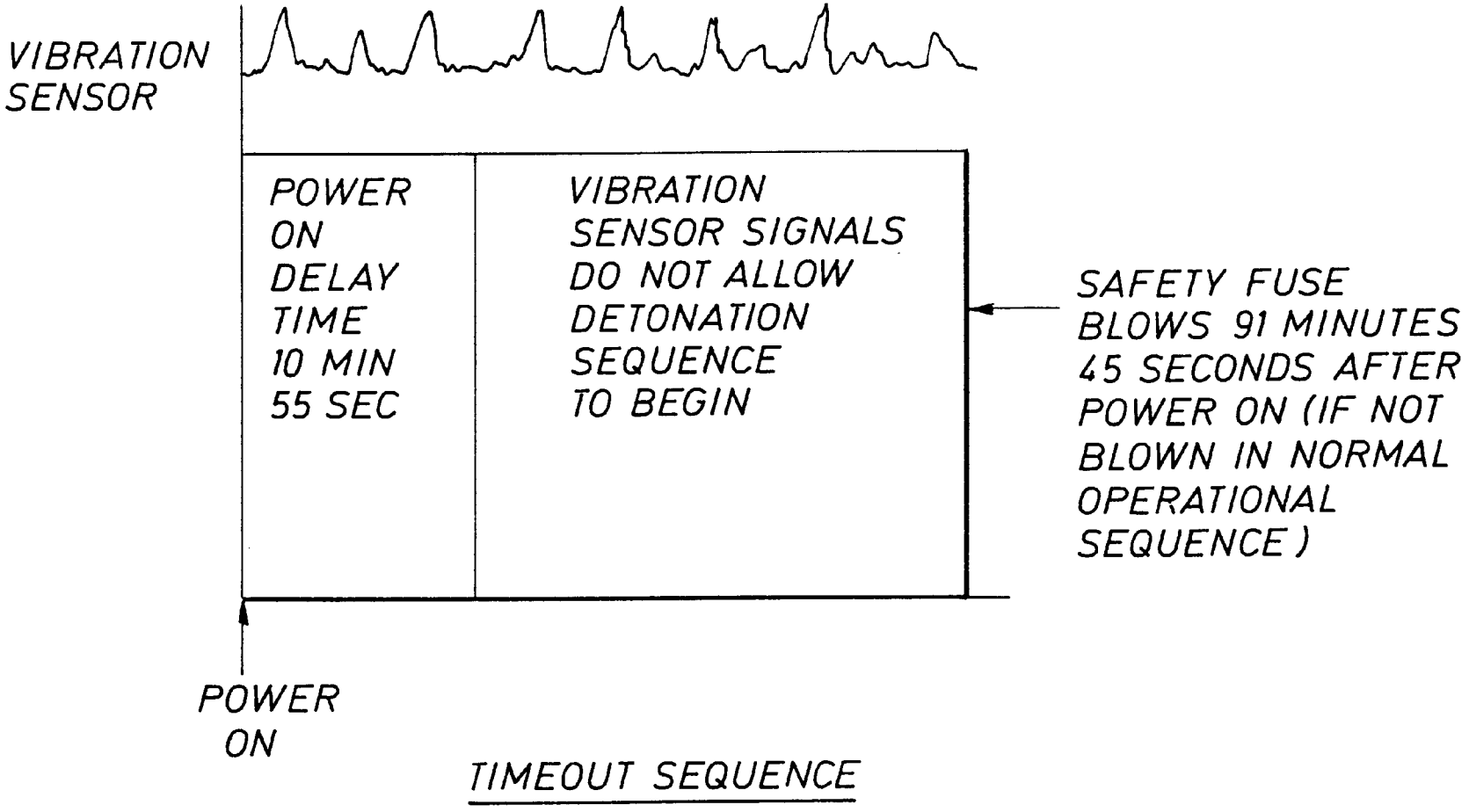
FIG. 6 is a chart illustrating a time-out sequence for the downhole triggering device of FIG. 1.

If vibration sensor 258 continues to detect motion and does not remain motionless for at least 13 minutes and 6 seconds, then a timeout sequence will operate to deactivate downhole triggering device A. As illustrated in FIG. 6, the safety fuse is blown 91 minutes and 45 seconds after device A is powered up if vibration sensor 258 continues to detect motion—without detecting motionlessness—for a period of at least 13 minutes and 6 seconds. This timeout sequence allows downhole triggering device A to be safely withdrawn to the surface without fear of an explosion on the surface. When the safety fuse 400 is blown, downhole triggering device A is deactivated.

Figure 10:
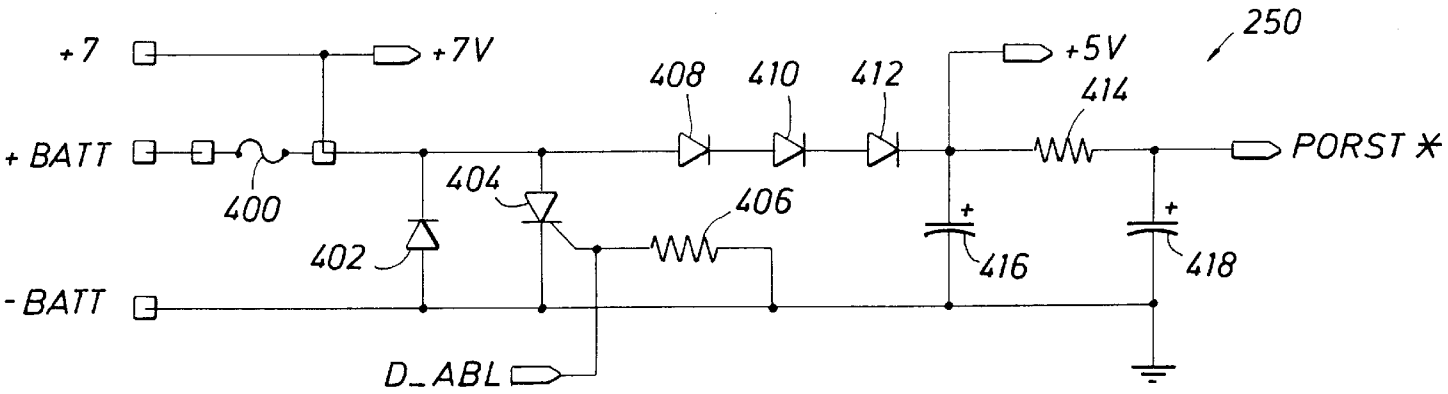
FIG. 10 is an electronic schematic for a timeout and post-fire safety fuse circuit for the downhole triggering device of FIG. 1.
Figure 11:
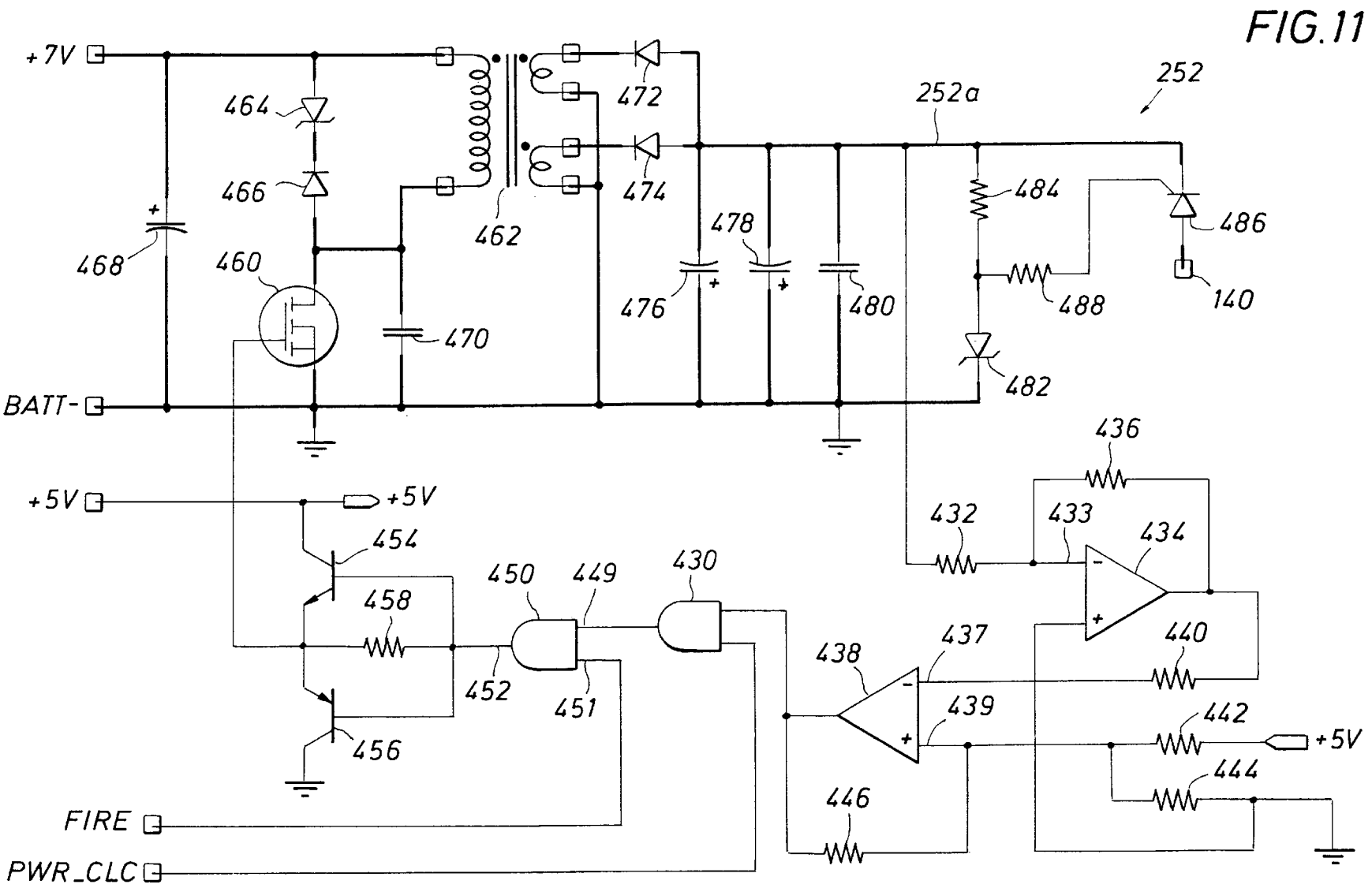
FIG. 11 is an electronic schematic for a detonator power circuit for the downhole triggering device of FIG. 1.

With reference to FIG. 4, electronics 18 includes five major parts: the timing circuit 256 (FIG. 7); control logic 254 (FIG. 8); the vibration sensor 258 (FIG. 9); the timeout and post-fire safety fuse circuit 250 (FIG. 10); and the detonator power circuit 252 (FIG. 11). The timing circuit 256 performs basic timekeeping functions, providing a time signal TBASE and a timeout signal T-OUT to control logic 254.

Control logic 254 implements overall control using input signals from the timing circuit 256, the vibration sensor 258, and the timeout and post-fire safety fuse circuit 250. After processing these signals, control logic 254 sends a disable signal D-ABL to the timeout and post-fire safety use circuit 250 and a firing signal FIRE to the detonator power circuit 252.

Vibration sensor 258 uses an accelerometer 270. Circuitry within vibration sensor 258 converts an analog signal generated by accelerometer 270 into a digital signal ACCEL, which is used in control logic 254 in generating the firing signal FIRE and the disable signal D-ABL.

The timeout and post-fire safety fuse circuit 250 regulates battery power to the control logic 254 circuit, provides a power-up delay to control logic 254 to make sure that all digital devices power-up in a known state, and also includes safety fuse 400, which disables downhole triggering device A after use or a master time-out occurs. Detonator power circuit 252 converts the battery voltage into potentials and currents that are used to detonate explosive 26.

With reference to FIGS. 5 and 6, control logic 254 operates as follows. When downhole triggering device A is powered up, several timers begin to operate. A master time-out timer runs for 91 minutes and 45 seconds before disabling triggering device A (if not already disabled after a successful fire). A timer operates for 10 minutes and 55 seconds before allowing any further tool operation (except the master time-out). After the initial 10 minute and 55 second delay, triggering device A begins monitoring the accelerometer 270 for signs that the tool is still moving in the well. If no accelerometer signal is present, control logic 254 will lock out the accelerometer signal 10 minutes and 55 seconds after the last active accelerometer signal, and 2 minutes and 11 seconds before a signal is generated to initiate firing of explosive 26. A signal to disable device A is generated 16 seconds after the fire signal is produced.

Control logic 254 circuitry, when first powered on, executes a reset cycle to insure that all electronic devices and gates become functional in a known state. This reset mechanism is part of the timeout and post-fire safety fuse circuit 250 and is explained in detail below with reference to FIG. 10.

Figure 7:
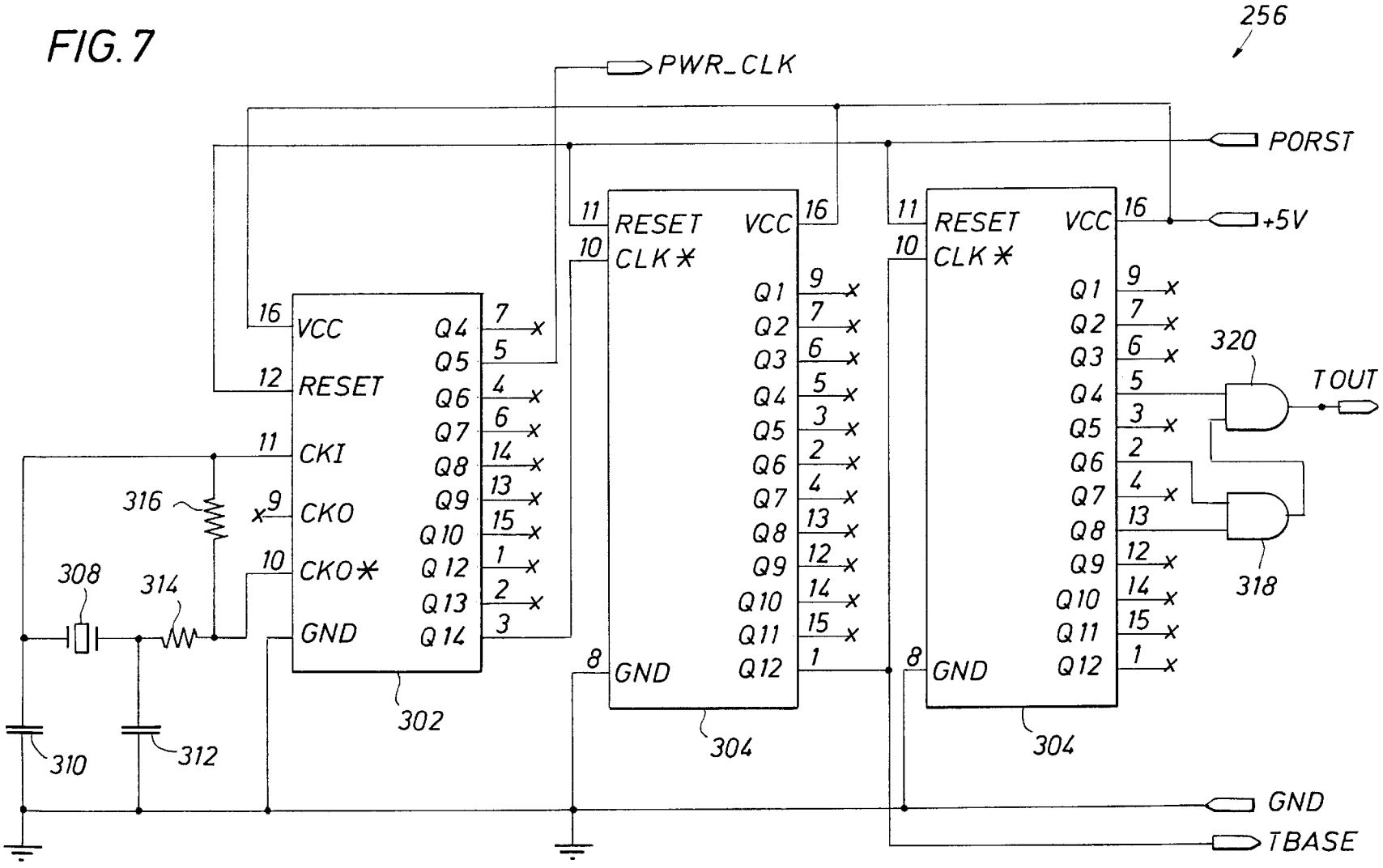
FIG. 7 is an electronics schematic for a timing circuit for the downhole triggering device of FIG. 1.

Turning now to FIG. 7, with continuing reference to FIGS. 4–6, timing circuit 256 is described. Timing circuit 256 uses a system time base generated by a counter 302 and its associated discrete components including a crystal 308, load capacitors 310 and 312, and resistors 314 and 316.

A first side of crystal 308 is converted to the CKI input of counter 302. Load capacitor 310 couples the first side of crystal 308 to ground, while load capacitor 312 couples a second side of crystal 308 to ground. The second side of the crystal 308 is coupled to the CKO* output of counter 302 through load resistor 314. A bias resistor 316 further couples the CKI input of counter 302 to its CKO* output. Together, crystal 308, load capacitors 310 and 312, and resistors 314 and 316 establish a resonance frequency signal (of 2.048 Mhz in the preferred embodiment) that is used as a clock signal in counter 302. Choice of component values in these types of clocking circuits is known to those skilled in the art.

Counter 302 is initialized when first powered up by a power-on reset signal PORST (described below) provided to its RESET input. The power-on reset signal PORST places counter 302 in a known state when first powered up. An output Q14 of counter 302 drives input CLK* of a second counter 304. The output Q14 of counter 302 is preferably a square wave clock at a frequency of 125 Hz. An output Q5 of counter 302 drives one input of a two input AND gate 430 in the detonator power circuit 252 (FIG. 11), providing a 64 kHz square wave clock signal PWR_CLK.

Counter 304 functions to divide down the signal at its CLK* input. In the disclosed embodiment of the invention, the Q12 output of counter 304 provides a square wave signal TBASE of approximately 0.0305 Hz. This square wave signal is provided to input CLK* of a third counter 306 and acts as a local time base throughout electronics 18. The power-on reset signal PORST is also provided to the RESET inputs of counters 304 and 306 such that each enters a known state after power is applied and the RESET signal is asserted. Outputs Q6 and Q8 of the counter 306 are coupled to the inputs of a two input AND gate 318. Output Q4 of the counter 306 is provided to one input of a two input AND gate 320, whose other input is connected to the output of AND gate 318. A master timeout signal T_OUT is driven by the output of AND gate 320, such that the signal T_OUT is asserted when Q4, Q6 and Q8 of counter 306 are at a logic high level.

Translating the binary number represented by outputs Q4, Q6 and Q8 (10101000) into a decimal number gives 168. In the disclosed embodiment, it takes 168 clock pulses occurring at 32.768 second intervals for all of outputs Q4, Q6, and Q8 of counter 306 to become high. The time required is 5505.024 seconds or 91 minutes and 45 seconds. Thus, the master timeout signal T_OUT is asserted after 91 minutes and 45 seconds have elapsed, as described with reference to FIG. 6.

This master timeout function is used to disable downhole triggering device A after 91 minutes and 45 seconds regardless of what has previously occurred. Disabling triggering device A after a fixed time period allows an operator to safely withdraw the device A to the surface if for some reason it was not fired.

Figure 8:
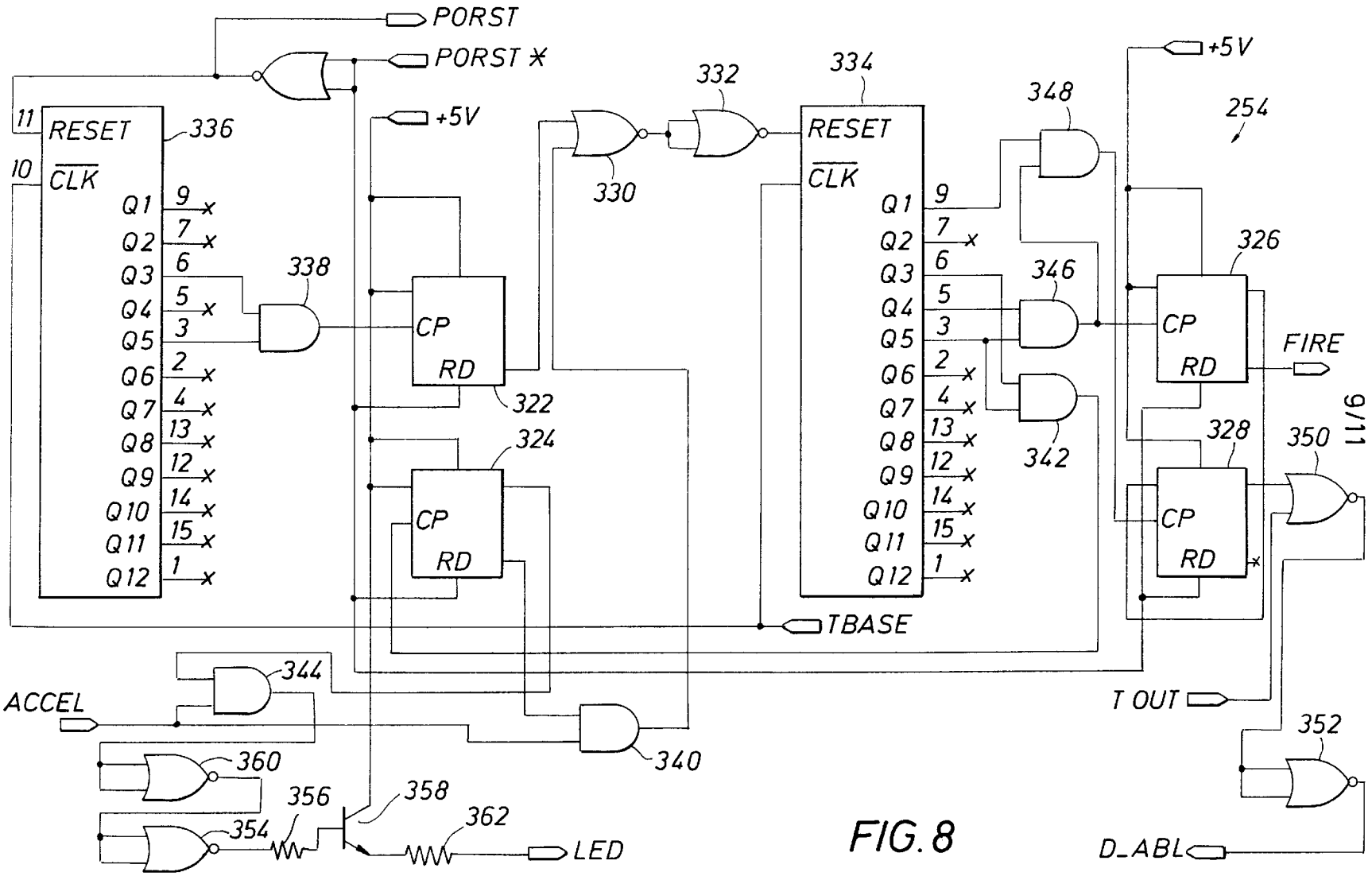
FIG. 8 is an electronic schematic for control logic for the downhole triggering device of FIG. 1.

With reference to FIG. 8, control logic 254 is described. Flip-flops 322, 324, 326 and 328 are placed initially in a state such that output Q of each individual gate is low. This initial state is provided by an inverted power-on reset signal PORST* that is provided to the RD input of each flip-flop 322, 324, 326 and 328. An inverted output from flip-flop 322 is initially in a high state and is connected to one input of a two input NOR gate 330. The out put of NOR gate 330 remains low as long as one of its inputs is high.

This low output drives the input of a NOR gate 332 so that whatever level is on, the input is inverted at the output. The output of NOR gate 332 drives an input RESET of a counter 334. Counter 334 is inhibited from performing any counting operation, and all of its outputs remain in a low state (from power-on reset) as long as the inverted output from flip-flop 322 does not change state.

A counter 336 begins counting the local time base TBASE after receiving the power-on reset signal PORST on an input RESET. After 10 minutes and 55 seconds have elapsed, counter 336 outputs Q3 and Q5 are high. Counter 336 outputs Q3 and Q5 drive both inputs to a two input AND gate 338. When both AND gate 338 inputs are high, the output of AND gate 338 is in a high state. The AND gate 338 output drives an input CP of flip flop 322. When the AND gate 338 output transitions from a low to a high state, the output clocks flip-flop 322 and changes its state from a low on its output Q (and high on its inverted output) to high (and low on its inverted output). The Q output of flip flop 322 has a low output state, and the inverted output has a high output state, initially.

The inverted output drives one input of AND gate 340 (as described above). A second input of AND gate 340 is driven by the output ACCEL from the vibration sensor 258 (FIG. 9) through an AND gate 340. The ACCEL signal drives one input of two input AND gate 340, and the inverted output of flip-flop 324 drives the other input. The output of AND gate 340 drives one input of NOR gate 330, providing a gated accelerometer signal as input RESET for counter 334. The output of AND gate 340 is low under these conditions as long as accelerometer 270 does not generate a signal. If accelerometer 270 generates a high signal (signaling detection of tool motion in the hole), as long as flip-flop 324 has not changed states, the output of AND gate 340 changes to a high state. If the 10 minute and 55 second initial power-on delay has not expired, the gated accelerometer signal (the counter output of NOR gate 332) will be ignored by counter 334 (it is already being held high by the inverted output of flip-flop 322). If the initial power-on delay has expired and vibration sensor 258 detects motion, accelerometer 270 will send signal ACCEL to AND gate 340, which will send a signal to NOR gate 330, which will be fed to counter 334 via input RESET, resetting counter 334 to its initial state (all outputs low). This is how vibration sensor 258 prevents detonation of explosive 26.

If vibration sensor 258 continues to detect motion, then counter 334 continues to be reset (via input RESET). Thus, as long as motion is detected by vibration sensor 258, counter 334 is unable to accumulate a count (and is therefore unable to sequence forward to detonate explosive 26.

When downhole triggering device A is lowered to its desired depth in a well, it is held motionless. After triggering device A becomes motionless in the well, the accelerometer 270 ceases to generate a signal. The gated accelerometer signal (counter 334 input RESET) ceases to reset counter 334. With clock signal TBASE as an input to counter 334, counter 334 sequences forward toward a firing signal. When counter 334 progresses forward ten minutes and 55 seconds (ten minutes and 55 seconds after the last accelerometer signal reset counter 334), outputs Q3 and Q5 of counter 334 change to a high state. Outputs Q3 and Q5 of counter 334 drive the inputs of a two input AND gate 342. As the inputs of AND gate 342 change to a high state, the output changes to a high state.

When the output of AND gate 342 changes to a high state, it clocks flip-flop 324, changing its output Q to a high state and its inverted output to a low state. As described above, the inverted output of flip-flop 324 drives one input of AND gate 340. When the inverted output changes to a low state, there is no output from AND gate 340, which effectively "locks out" any further accelerometer input signals.

At this point the firing sequence is inevitable. Two minutes and 11 seconds after accelerometer 270 lock-out occurs, outputs Q4 and Q5 of counter 334 change state. Since outputs Q4 and Q5 of counter 334 are inputs of an AND gate 346, the output of AND gate 346 changes state, clocking flip-flop 326. With a change in outputs Q4 and Q5 of counter 334, an inverted output from flip-flop 326 changes from an initial high state to a low state, initiating firing of explosive 26 via a signal FIRE. Thus, downhole triggering device A is triggered causing an explosion downhole which can be used in a perforating gun or other downhole explosive device.

Thirty-two seconds later an AND gate 348 input (driven by output of AND gate 346) and counter 334's output Q1 become active, changing the AND gate 348 output to a high state. This change in output clocks an input of flip-flop 328, changing its Q output from a low to a high state, initiating disable signal D_ABL through NOR gates 350 and 352. NOR gate 350 receives as an input the master time-out signal T_OUT that is generated 91 minutes and 45 seconds after power up. Either the Q output from flip-flop 328 or the master time-out signal T_OUT can generate the disable signal D_ABL. The output of NOR gate 350 drives both inputs of NOR gate 352 so that the output of NOR gate 352 is inverted to produce a correct polarity for the disable signal D_ABL.

A NOR gate 354 has an output, which through a resistor 356 turns on a transistor 358 to light the light emitting diode (LED) 262 to indicate detection of motion. AND gate 344 receives the accelerometer signal ACCEL and (the accelerometer lockout) the flip-flop 324 Q output as inputs. The output from AND gate 344 drives both inputs of a NOR gate 360 which provides an output to drive both inputs of NOR gate 354. As long as the accelerometer lockout has not been activated (through flip flop 324), the accelerometer signal ACCEL is passed through NOR gates 360 and 354 to turn on or off transistor 358 which in turn lights or extinguishes LED 262. Transistor 358 switches a standard 5 volt power source on its collector to LED 262 on its emitter through a resistor 362.

Figure 9:
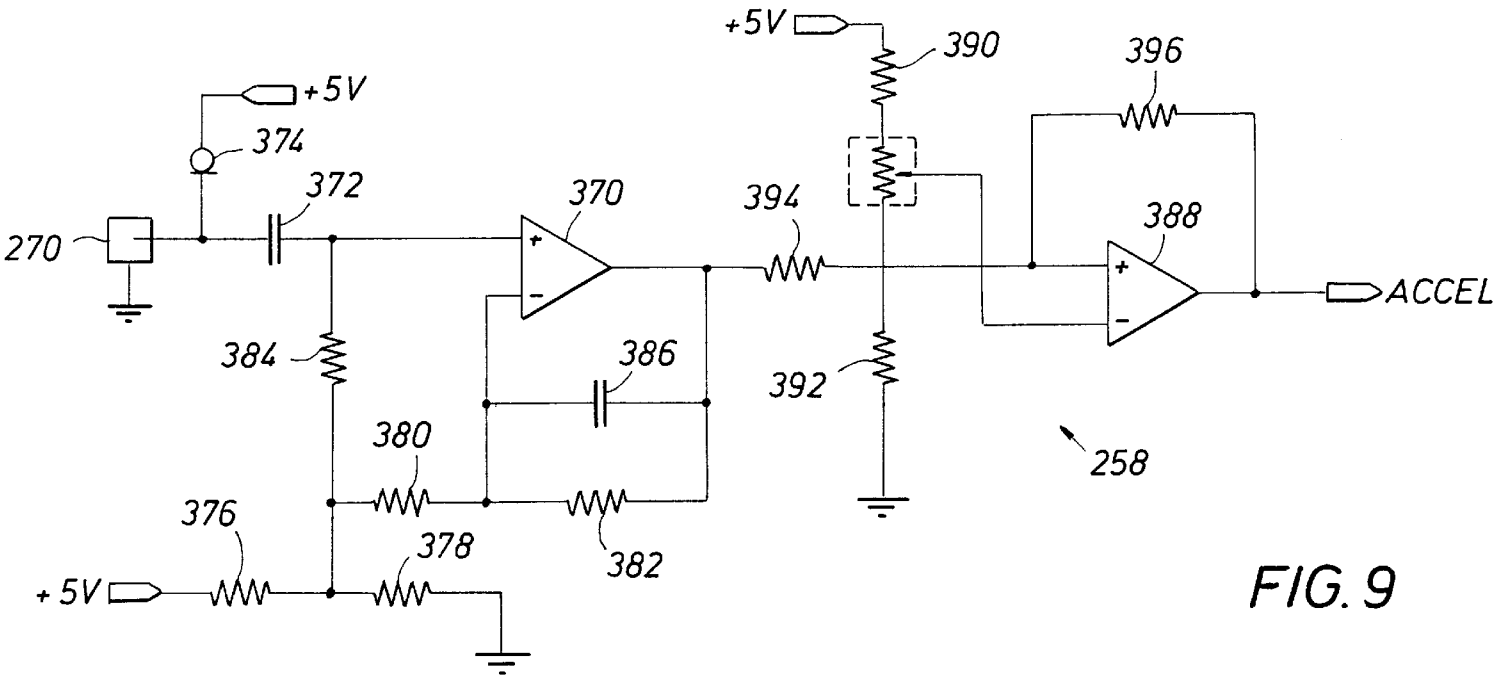
FIG. 9 is an electronic schematic for a vibration sensor for the downhole triggering device of FIG. 1.

Turn now to FIG. 9, which illustrates the components and circuitry of vibration sensor 258. Accelerometer 270 is a solid state sensor that detects changes in acceleration (and thereby motion) and produces an output voltage proportional to the acceleration of the sensor. This output signal is coupled to an operational amplifier 370 through a capacitor 372. A current diode 374 provides a bias current of 560 microamperes for the operation of the sensor. Operational amplifier 370 incorporates resistors 376, 378, 380, 382, 384 and a capacitor 386 to amplify a small signal generated by accelerometer 270 into a more usable signal level.

A standard 5 volt source is connected to ground through series resistors 376 and 378. Resistor 384 is connected between a node between resistors 376 and 378 and a node between the output of capacitor 372 and an input of operational amplifier 370. Resistor 380 and resistor 382 are connected in series between a node on the line between resistors 376 and 378 and 384 and an output of operational amplifier 370. A second input for operational amplifier 370 is connected to a node between resistors 380 and 382. Capacitor 386 connects between the second input of operational amplifier 370 and its output.

An operational amplifier 388 is configured as a comparator. A reference voltage is provided as an inverting input to operational amplifier 388 by a combination of resistors 390 and 392. A standard 5 volt source is connected to ground through resistors 390 and 392 (selectable resistance) in series. The common node formed by resistors 390 and 392 is provided as the inverting input. An optional potentiometer can be used to adjust the reference voltage at the inverting input of operational amplifier 388. By selecting an appropriate value for resistor 392, the reference level, and thereby the sensitivity, of the accelerometer circuit can be adjusted.

The output of operational amplifier 370 (the amplified accelerometer signal) drives a non-inverting input of the operational amplifier 388 through a resistor 394. If the signal from the accelerometer is greater than the reference voltage, a high signal is generated as an output of the operational amplifier 388. A resistor 396 is connected between the input (signal from accelerometer) and the output of operational amplifier 388 for determining the amount of hysteresis, or resistance to small changes, that is allowed in this input. The hysteresis applied to the circuit stabilizes the response to signal changes in the accelerometer signal and improves the ability of the circuit to discriminate between a real signal and noise. The output of operational amplifier 388 provides the accelerometer signal ACCEL.

Turn now to FIG. 10, which illustrates the timeout and post-fire safety fuse circuit 250. Power for downhole triggering device A is provided by 5 C-cell batteries (battery pack 14) delivering approximately 7 to 7.5 volts (nominal). Battery pack 14 is connected to this circuitry through safety fuse 400, as discussed earlier with reference to FIGS. 5 and 6. A diode 402 is installed across the terminals of the battery pack 14 to prevent damage to electronics 18 in the event that batteries 14*a* are installed backwards, blowing fuse 400 instead.

A silicon controlled rectifier (SCR) 404 is a disable device connected in parallel to diode 402 to the terminals of diode 402. SCR 404 has a gate connected to ground through a resistor 406. The disable signal D_ABL from NOR gate 352 (FIG. 8) connects between the gate of SCR 404 and resistor 406 to drive SCR 404. When SCR 404 receives the disable signal D_ABL from NOR gate 352, SCR 404 turns on, effectively shorting the battery pack 14 through fuse 400. In this event fuse 400 blows, and battery pack 14 is disconnected from electronics 18, regardless of the position of upper switch 100 and lower switch 200. This allows an operator to safely withdraw downhole triggering device A from a well, preventing an explosion at the surface from an undetonated explosive.

Diodes 408, 410 and 412 are connected in series with a resistor 414 with the positive terminal of SCR 404 to provide the inverted power-on reset signal PORST* for input to flip-flops 322, 324, 326 and 328 as described above with reference to FIG. 8. Diodes 408, 410 and 412 reduce the voltage available to control logic 254 to a rated 5 volts from the nominal battery pack 14 voltage of 7 to 7.5 volts. Each diode 408, 410 and 412 has approximately a 0.6 volt "drop" across it when conducting current. A capacitor 416 connects between ground and a node between diode 412 and resistor 414. From this node between diode 412 and resistor 414, a standard 5 volt source is provided.

Capacitor 416 is a filtering capacitor that removes spikes and noise from the 5 volt source. A capacitor 418 is connected between ground and the inverted power-on reset signal PORST*. The combination of resistor 414 and capacitor 418 provides the power-on reset or delay to control logic 254. As the power is turned on, capacitor 418 slowly charges through resistor 414 until it crosses a threshold where control logic 254 begins to operate. The time the network takes to cross this threshold is the reset delay time. The reset delay time is approximately one quarter of a second.

With reference to FIG. 11, detonator power circuit 252 is a flyback-type switching power supply with certain modifications for this application. The 64 kHz clock (PWR_CLK) from output Q5 of counter 302 (FIG. 7) is the basic switching frequency of the supply. This drives an input of an AND gate 430 and does not pass through the AND gate 430 output unless a second input of AND gate 430 is at a logic high level. The second input of AND gate 430 is determined indirectly by a feedback voltage generated from output voltage of a firing power supply 252*a*.

A sample of the output voltage from firing power supply 252*a* is taken through a resistor 432 to drive an input 433 of an operational amplifier 434. Operational amplifier 434 provides an attenuation stage that reduces the output voltage (typically around 82 volts) to a signal that is in the range that operational amplifier 434 is able to process. A feedback resistor 436 connects between input 433 and the output of operational amplifier 434.

The output drives an input 437 of an operational amplifier 438 through a resistor 440. A 5-volt source is connected to an input 439 through a resistor 442. A resistor 444 connects between ground and the common node between resistor 442 and input 439. A compensation resistor 446 connects between input 439 and the output of amplifier 438. This output drives one input of AND gate 430, such that the input is at a logic high level if the output voltage of firing power supply 252*a* is above a predetermined threshold level.

Specifically, operational amplifier 438 is configured as a comparator with a reference voltage set at 2.5 volts on input 439. Through resistor 432 a scaled down representation of the output voltage of firing power supply 252*a* is provided to the input of operational amplifier 434. If input 437 rises above the reference 2.5 volts on input 439, then the output of operational amplifier 438 changes from its normal high state to a low state. This change from a high state to a low state disables the clock input (PWR_CLK) and turns the power supply off.

If the output voltage of firing power supply 252*a* remains below the predetermined limit, the clock input (PWR_CLK) passes through to the output of AND gate 430. The output of AND gate 430 drives an input 449 on an AND gate 450. The clock signal PWR_CLK is not present at the output of AND gate 450 unless the fire signal FIRE from the logic circuit is also present at an AND gate 450 input 451. Once both signals are present the clock signal PWR_CLK is present at an output 452 of AND gate 450 and is connected through transistors 454 and 456 and a resistor 458 to a switching N-channel metal oxide semiconductor field effect transistor (MOSFET) 460.

The bases of transistors 454 and 456 are connected together, and the transistor 454 emitter connects to the transistor 456 collector. A 5-volt source is connected to the transistor 454 collector, and the transistor 456 emitter is connected to ground. Resistor 458 connects between a node between the transistor 454 emitter and the transistor 456 collector and a node between the bases of transistors 454 and 456. Output 452 connects to the node between the bases of transistors 454 and 456. The node between the transistor 454 emitter and the transistor 456 collector is connected to the gate of MOSFET 460.

Transistors 454 and 456 and resistor 458 provide a network for increasing the current drive of output 452 of AND gate 450 to drive the gate of the switching MOSFET 460 effectively. Switching MOSFET 460 is connected between one end of the primary side of a flyback transformer 462 and ground. The other end of the primary side of the flyback transformer 462 is connected to battery pack 14 through fuse 400 (FIG. 10). When MOSFET 460 is switched to an on or closed position for conducting between its source and drain, a magnetic field builds up in the primary side and the core of transformer 462, storing energy in the core. When MOSFET 460 turns off the magnetic field collapses, and the energy stored in the core is released. The secondary windings of transformer 462 "collect" the stored energy and because the secondary windings have more turns of wire around the core than the primary winding, the secondary windings generate a higher voltage at their outputs than was present across the primary. Transformer 462 has preferably an 11:1 turn ratio with 3 turns on the primary and 33 on the secondary winding.

Some of the energy stored in the core of transformer 462 is dumped back into the primary and must be eliminated for proper operation of the supply. A zener diode 464 and a schottky diode 466 act as energy absorbers and "snub" the excess energy. One terminal of zener diode 464 connects to a node between battery pack 14 and the primary of transformer 462, and the other terminal of zener diode 464 connects to schottky diode 466. A capacitor 468 connects between ground and a node between battery pack 14 and the node connected to zener diode 464.

Switching MOSFET 460 turns on and off 64,000 times in one second, and the energy transfer is very efficient at this frequency. The source of MOSFET 460 connects to schottky diode 466, and its drain connects to ground. A node between the source of MOSFET 460 and schottky diode 466 is connected to the primary winding of transformer 462, at an end of the primary winding distal to the connection with zener diode 464. A capacitor 470 connects between ground and a node between the source for MOSFET 460 and the primary winding of transformer 462.

The energy "collected" by the secondary windings of transformer 462 is in the form of an alternating voltage. Diodes 472 and 474 connect to the secondary windings of transformer 462 and "steer" the current flow in the proper direction so that the voltage that appears across capacitors 476,478 and 480 is the appropriate polarity. Capacitors 476 and 478 store an electric charge from the potential impressed across them. Capacitors 476 and 478 are preferably about 86 $\mu$F, 100 V. Capacitors 476, 478 and 480 are connected in parallel between ground and the output terminal of diodes 472 and 474, diodes 472 and 474 being in parallel and connected together at their output terminals.

In parallel with capacitors 476, 478 and 480, a zener diode 482 (preferably a 1N5374A, 82 V, 5 WT) is connected at its cathode to ground and at its anode to a resistor 484 (preferably 10 K ohms). Resistor 484 is connected to the output terminal of diodes 472 and 474. A silicon controlled rectifier (SCR) 486 (preferably an S4010SL2) is connected at its cathode to the output terminal of diodes 472 and 474. A resistor 488 connects between the gate of SCR 486 and a node between zener diode 482 and resistor 484. The anode of SCRl 486 connects to contact prong 140, which is connected to firing head 24 of explosive 26 through lower switch 200 (FIG. 1)

It is by power on the anode terminal of SCR 486, which is connected to contact prong 140, that explosive 26 is detonated. Lower switch 200 provides a switch between explosive 26 and ground (FIG. 4). The output from SCR 486 to firing head 24 meets the requirements of Recommended Practice 67 provided by the American Petroleum Institute, namely at least 200 milliamperes through a minimum DC resistance of 50 ohms. The resistance through explosive 26 is at least 50 ohms, and the current through explosive 26 during detonation is at least 200 milliampere. The voltage across explosive 26 is the zener voltage of zener diode 482, which is about 82 volts. Thus, if the resistance through explosive 26 is about 50 ohms, then the current through explosive 26 is about 1.6 amperes for the necessary period of time.

As capacitors 476, 478 and 480 charge, the voltage across these devices gradually builds up to a predetermined level governed by transformer 462 characteristics and secondary circuit elements. SCR 486 does not initially conduct any current, and therefore no current flows through explosive 26. When the voltage across capacitors 476, 478 and 480 exceeds 82 volts (the zener voltage of zener diode 482) current begins to flow through resistor 484 and zener diode 482. When current flows in this branch of the circuit, a voltage is generated at the gate of SCR 486, turning SCR 486 on and allowing the capacitors 476, 478 and 480 to rapidly discharge their stored energy in a short time through explosive 26. This discharge detonates explosive 26.

After explosive 26 has fired the SCR 486 branch of the circuit is open, and the power supply through transformer 462 recharges capacitors 476, 478 and 480 as described above until downhole triggering device A is disabled as described. As described with reference to FIGS. 5 and 8, sixteen seconds after discharging capacitors 476, 478 and 480 through SCR 486, the disable signal D_ABL is received on the gate of SCR 404 (FIG. 10), closing that switch and shorting battery pack 14 through fuse 400. This blows fuse 400 so that downhole triggering device A can be withdrawn to the surface with battery pack 14 disconnected from electronics 18, including disconnect from transformer 462.

In broader terms the detonator power circuit can be described as including a feedback circuit and a switching device (SCR 486) having a first terminal and a second terminal, where the switching device is responsive to an actuation signal to electrically short the first terminal and the second terminal. Transformer 462 has a primary side and a secondary side, with a greater number of windings on the secondary side to allow a greater voltage to be present on the secondary side. The primary side is coupled across the battery (or power supply) terminals, and the secondary side is coupled to the first terminal of the switching device. Capacitors 476, 478 and 480 serve as a charge storing element, and the actuation signal is provided by actuation circuitry, which includes zener diode 482.

The feedback circuit includes voltage comparator circuitry and a switching element (MOSFET 460) responsive to a second actuation signal to electrically short its terminals, where one of its terminals is connected to one of the terminals of the power supply and the other is connected to a terminal of the primary side of the transformer. Power is provided to the transformer from the power supply when the second actuation signal (the FIRE signal) is present.

The voltage comparator circuitry includes operational amplifiers 434 and 438 and gates 430 and 450. This voltage comparator circuitry is coupled to the secondary side of the transformer and the switching element and is configured to compare a representation of the voltage across the charge storing element to a reference voltage to determine if the voltage across the charge storing element is above a predetermined level. The predetermined level is typically chosen to be a certain safety margin below the breakdown or failure voltage of the charge storing elements. The voltage comparator circuitry de-asserts the second actuation signal during periods in which the voltage across the charge storing element would otherwise rise above the predetermined level and damage the charge storing elements. These time periods are typically those following the detonation of the explosive but before downhole triggering device A disables itself.

Benefits and Advantages of the Present Invention

With the present circuitry, downhole triggering device A can be transported in a helicopter. When the prior art triggering device is unassembled in its various sections, a battery and electronics section, which is the longest section, is about 6.5 feet in length. Downhole triggering device A breaks down into a top switch, a battery and electronics section, a bottom switch, and an explosive. The battery and electronics section in the present invention is the longest section and is about four feet in length, which is short enough to be transported in a helicopter for access to offshore oil and gas wells. Transport by helicopter is significant because it is much faster than transport by boat, which is the required means of transport for the longer prior art triggering device. A significantly shorter length for downhole triggering device A is achieved because only five C-cell batteries in alignment with each other are required while the prior art triggering device requires fifty-two AA batteries, which are arranged in three columns. The electronics 18 allow explosive 26 to be detonated safely and effectively using as a power supply only five C-cell batteries.

The overall length of downhole triggering device A is about 71 inches, while the prior art triggering device is about 132 inches. Nearly half of this difference is accounted for in the batteries. The shorter length of the present invention allows it to be used in a horizontal well having a tight radius bend between a vertical run and a horizontal run. As more horizontal wells are being drilled, a tool that can pass through short radius bends provides a significant advantage over one that cannot. Battery pack 14, electronics 18, and in particular, detonator power circuit 252 cause downhole triggering device A to be shorter than the prior art triggering device.

The circuitry used in the present invention allows a power supply of only 7 to 7.5 nominal voltage to be used, which allows downhole triggering device A to be shorter than the prior art triggering device. Prior art circuitry switched battery power directly to the explosive, while in the present invention battery power is stepped up in voltage through a flyback-type switching power supply using transformer 462 with energy being stored in capacitors 476, 478 and 480. The device MOSFET 460 allows very efficient energy storage in capacitors 476, 478 and 480 through transformer 462. Zener diode 482 allows the voltage to build up to the zener voltage for zener diode 482, which in this embodiment is 82 volts, before zener diode 482 conducts, which effectively closes a switch. That switch is SCR 486 which conducts when current flows through resistor 484 and zener diode 482, applying voltage on the gate of SCR 486, allowing capacitors 476, 478 and 480 to discharge their stored energy through SCR 486 into explosive 26.

Shear pins 108 offer several advantages over the prior art. Prior art triggering devices have switches like upper switch 100 and lower switch 200, which close typically at 150 psig and 95 psig, respectively. In a well bore containing fluid, these pressure-activated switches are closed when the prior art triggering device is lowered to approximately 300 feet depth by the hydrostatic head of the fluid. The prior art triggering device thereafter relies entirely on a motion sensor to reset a clock to zero. This is not ally reliable, particularly in a horizontal well. Thus, the prior art triggering device can explode before being set in a desired location.

Downhole triggering device A on the other hand provides a very predictable explosion, allowing downhole triggering device A to be set where desired before being activated. Shear pins 108 allow downhole triggering device A to be maintained in a deactivated state until an operator is ready to detonate an explosive.

In setting off an explosive in a very deep well using a prior art triggering device, the run-in time presents a problem. A prior art triggering device is activated (switches are closed) after descending about 300 feet and thereafter relies entirely on its motion sensor to reset its clock to zero. Even if the motion sensor works, time may run out before the prior art triggering device is set in place. This would be analogous to the timeout signal T_OUT of the present invention causing fuse 400 to blow, deactivating the triggering device. With downhole triggering device A on the other hand, activation can be delayed by using shear pins 108 to prevent upper switch 100 from closing. This allows downhole triggering device A to be lowered to great depths before power is turned on by closing of switches 100 and 200.

For example, in one test a single shear pin 108 was shorn by hydrostatic pressure at a depth of about 1800 feet (a pressure of about 1,300 psia). Two shear pins 108 were shorn at a depth of about 3200 feet. Three shear pins 108 were shorn at a depth of about 4800 feet, and four were shorn at a depth of about 6400 feet. Depending on the depth of the well, shear pins 108 can be added to delay activation of downhole triggering device A so that time does not run out and so that an operator does not have to rely solely on vibration sensor 258 for a long period of time.

If downhole triggering device A is run in using coiled tubing, the run-in time is longer because coiled tubing is run in more slowly than slick wireline. Without shear pins 108, triggering device A would possibly run out of time (fuse 400 being blown by the time-out signal T_OUT activating the disable signal D_ABL). Even if triggering device A did not run out of time, it would have to rely on vibration sensor 258 for an extended period of time, which is less desirable than the predictability obtained using shear pins 108.

Where downhole pressure does not exceed the shear strength of shear pins 108, triggering device A can be operated even more predictably. An operator can pump fluid into the well bore to raise the pressure to sever shear pins 108. In this case triggering device A is not activated until the operator pumps fluid to shear the shear pins 108. Triggering device A can be set in place and then be activated from the surface. Thus, direct control from the surface is obtained.

Shear pins 108 also provide safety at the surface. Downhole triggering device A can be placed in a lubricator at the surface of a cased well bore, and triggering device A can withstand pressure in the lubricator. A lubricator can be subjected to pressures ranging from about 0 to 4,000 psig. A prior art triggering device would be activated when the pressure exceeded about 150 psig and could explode at the surface if not lowered within a predetermined time delay. In contrast, triggering device A can have upper switch 100 pinned open using shear pins 108 so that even a pressure of 4000 psig would not activate triggering device A (by using about four shear pins 108 of suitable hardness).

Modifications and alterations to the embodiments disclosed herein will be apparent to those skilled in the art in view of this disclosure. The foregoing disclosure and description of the invention are illustrative and explanatory only, and various changes in the size, shape, materials, components, circuit elements, wiring connections and contacts, as well as the details of the illustrated circuitry and method of operation may be made. It is intended that all such variations and modifications fall within the spirit and scope of this invention as claimed.

What is claimed is:

1. A downhole tool comprising:

a housing;

a first pressure-activated switch;

a second pressure-activated switch;

electrical circuitry coupled to said first and second pressure-activated switches;

a power supply for the electrical circuitry; and a voltage increasing mechanism in the electrical circuitry to obtain an operating voltage sufficient for detonating an explosive, wherein the operating voltage exceeds the voltage supplied by the power supply, the voltage increasing mechanism including a feedback circuit for ramping up voltage supplied by the power supply.

2. The downhole tool of claim 1, wherein the circuit provides an output of at least 200 milliamperes through a 50 ohm resistor.

3. The downhole tool of claim 1, wherein the voltage increasing mechanism includes a transformer for stepping up voltage provided by the power supply and a switching element in the feedback circuit for selectively and functionally connecting and disconnecting the transformer to the power supply.

4. The downhole tool of claim 1, further comprising a vibration sensor in the circuitry.

5. The downhole tool of claim 1, wherein the first pressure-activated switch includes a piston slidably disposed within the housing.

6. The downhole tool of claim 5, further comprising a shear pin for holding the piston of the first pressure-activated switch in a first position, wherein the shear pin can be severed by pressure acting on the piston.

7. The downhole tool of claim 1, wherein the voltage increasing mechanism includes:

a step-up transformer having a primary side and a secondary side; and a capacitor coupled to the secondary side for storing energy from the step-up transformer, wherein the feedback circuit is coupled to the capacitor and the primary side, the feedback circuit including a switching device for selectively connecting and disconnecting the primary side to the power supply for purposes of building charge in the capacitor.

8. A downhole triggering device for detonating an explosive in a well bore, comprising:

a housing;

a system of electrical components disposed in the housing for connecting to and detonating the explosive;

wherein the system of electrical components includes a detonator power circuit for providing sufficient power to detonate the explosive, the detonator power circuit comprising:

a switching device having a first terminal and a second terminal, the switching device responsive to an actuation signal to electrically short the first terminal and the second terminal, wherein the second terminal connects to the explosive;

a transformer having a primary side and a secondary side, the secondary side incorporating a greater number of windings than the primary side to allow a greater voltage to be present on the secondary side, the power supply having two power terminals, wherein the primary side is coupled across the power terminals and the secondary side is coupled to the first terminal of the switching device;

a charge storing element coupled to the first terminal of the switching device;

actuation circuitry coupled to the switching device, wherein the actuation circuitry provides the actuation signal to the switching device after charge stored in the charge element reaches a predetermined level, the actuation signal causing the charge stored in the charge storing element to be provided to the explosive through the switching device; and a feedback circuit coupled to the charge storing element and the primary side of the transformer for ramping up charge stored on the charge storing element.

9. The downhole triggering device of claim 8, wherein the switching device is a silicon controlled rectifier.

10. The downhole triggering device of claim 8, wherein the charge storing element is a capacitor.

11. The downhole triggering device of claim 8, wherein the feedback circuit comprises:

a switching element having a third terminal and a fourth terminal, the switching element responsive to a second actuation signal to electrically short the third and fourth terminals, wherein the third terminal is connected to one of the power terminals and wherein the fourth terminal is connected to a terminal of the primary side of the transformer such that power is provided to the transformer from the power supply when the second actuation signal is present; and voltage comparator circuitry coupled to the secondary side of the transformer and the switching element, the voltage comparator circuitry configured to compare a representation of the voltage across the charge storing element to a reference voltage to determine if the charge stored in the charge storing element is at a predetermined level, the voltage comparator circuitry asserting the second actuation signal during periods in which the charge stored in the charge storing element is less than the predetermined level.

12. The downhole triggering device of claim 11, wherein the second actuation signal is disabled periodically in response to a clock signal.

13. The downhole triggering device of claim 12, wherein the clock signal has a frequency of approximately 64 Khz.

14. The downhole triggering device of claim 11, wherein the system of electrical components includes a vibration sensor, and the second actuation signal is asserted if the vibration sensor indicates motionlessness.

15. The downhole triggering device of claim 8, wherein the housing has a bore and the system of electrical components includes a pressure-activated switch, further comprising a piston slidably disposed in the bore for closing the pressure-activated switch and a shear pin for holding the piston in a first position.

16. The downhole triggering device of claim 11, wherein the system of electrical components includes a control logic circuit providing a fire signal and a timing circuit providing a clock signal, the fire signal and the clock signal being provided to the feedback circuit, wherein both the fire signal and the clock signal must be asserted for the second actuation signal to be asserted.

17. The downhole triggering device of claim 16, wherein the clock signal has a clock frequency and the clock frequency is impressed on the second actuation signal so that the third and fourth terminals of the switching element are shorted at approximately the clock frequency.

18. The downhole triggering device of claim 11, wherein the third and fourth terminals of the switching element are shorted thousands of times per second, wherein a magnetic field builds on the primary side of the transformer and then collapses at about the frequency that the third and fourth terminals are shorted, wherein charge is accumulated in the charge storing element each time the magnetic field collapses.

19. A downhole tool comprising:

a housing;

a first pressure-activated switch disposed in the housing;

a piston responsive to fluid pressure for engaging the first pressure-activated switch;

a shear pin for releasably locking the piston in a fixed position;

a second pressure-activated switch; and electrical circuitry coupled to the first and second pressure-activated switches, the electrical circuitry being activated upon closure of both the first and the second pressure-activated switches, the electrical circuitry including:

a power supply for supplying power for the electrical circuitry;

a timer circuit that is activated upon activation of the electrical circuitry;

a detonator for an explosive; and a voltage ramping circuit coupled to the power supply and the detonator for providing an operating voltage at the detonator that is greater than the voltage supplied by the power supply, the voltage ramping circuit including:

a step-up transformer having a primary side and a secondary side, the primary side being coupled to the power supply;

a charge storing element coupled between the secondary side and the detonator; and a feedback circuit coupled between the charge storing element and the primary side, the feedback circuit including a switching element for connecting and disconnecting the primary side to the power supply for accumulating charge on the charge storing element.

20. The downhole tool of claim 19, further comprising a vibration sensor circuit in the electrical circuitry, wherein the operating voltage at the detonator is provided after a delay in time following activation of the electrical circuitry provided the vibration sensor does not detect vibration.

21. The downhole tool of claim 20, further comprising a fuse in the electrical circuitry, wherein the fuse is blown after a first period of time provided the vibration sensor continues to detect vibration for a second period of time, and wherein the fuse is blown after the operating voltage is provided at the detonator.

* * * * *